US009695544B2

(12) United States Patent
Cavarretta et al.

(10) Patent No.: US 9,695,544 B2
(45) Date of Patent: Jul. 4, 2017

(54) DRYER WITH AIR RECIRCULATION/HEAT EXCHANGE SUBASSEMBLY

(75) Inventors: Francesco Cavarretta, Pordenone (IT); Massimiliano Vignocchi, Pordenone (IT); Maurizio Ugel, Pordenone (IT); Alberto Bison, Pordenone (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 1026 days.

(21) Appl. No.: 13/437,501

(22) Filed: Apr. 2, 2012

(65) Prior Publication Data

US 2013/0255099 A1 Oct. 3, 2013

(51) Int. Cl.

| | |
|---|---|
| ***D06F 58/00*** | (2006.01) |
| ***F26B 11/18*** | (2006.01) |
| ***D06F 58/02*** | (2006.01) |
| ***D06F 58/20*** | (2006.01) |

(52) U.S. Cl.

CPC ..... *D06F 58/02* (2013.01); *D06F 58/20* (2013.01)

(58) Field of Classification Search

CPC ..... F26B 11/02; F26B 11/028
USPC ..... 34/192, 195–197, 108, 131; 454/266, 454/265, 264, 333, 347, 348, 358, 361, 454/363, 261, 359, 226, 227
See application file for complete search history.

(56) References Cited

U.S. PATENT DOCUMENTS

| | | | | |
|---|---|---|---|---|
| 5,315,765 | A | 5/1994 | Holst et al. | |
| 7,228,647 | B2 | 6/2007 | Hong | |
| 7,434,333 | B2 | 10/2008 | Yang et al. | |
| 2007/0057084 | A1* | 3/2007 | Vieira | 239/34 |
| 2008/0189974 | A1* | 8/2008 | Dittmer et al. | 34/132 |
| 2009/0229141 | A1* | 9/2009 | Nawrot | D06F 58/02 34/467 |
| 2010/0132217 | A1* | 6/2010 | Steffens | 34/480 |
| 2010/0146811 | A1 | 6/2010 | Steffens | |
| 2011/0041353 | A1 | 2/2011 | Bache et al. | |
| 2011/0198405 | A1* | 8/2011 | Krausch | D06F 58/206 236/44 C |

(Continued)

FOREIGN PATENT DOCUMENTS

| | | |
|---|---|---|
| DE | 30 00 865 | 7/1981 |
| EP | 0 049 170 | 7/1985 |
| EP | 0 163 265 | 12/1985 |

(Continued)

*Primary Examiner* — Kenneth Rinehart
*Assistant Examiner* — John McCormack
(74) *Attorney, Agent, or Firm* — Banner & Witcoff, Ltd.

(57) ABSTRACT

A laundry dryer is provided with a modular air recirculation subassembly fitted beneath a rotatable drum of the dryer. The subassembly has an air recirculation passage provided between an air supply passage and an air exhaust passage of the dryer. The air recirculation subassembly further has a flow directing flap at the juncture of the air inlet passage and the air recirculation passage to direct the recirculation air flow toward a heater and away from an inlet end of the air supply passage. The air recirculation subassembly may include a filter positioned across the air recirculation passage upstream of the heater, which filter is removable through the air exhaust passage. The subassembly may further include a heat exchanger to transfer heat from the warmer air exiting the exhaust passage to the cooler air entering the air supply passage, and a recirculation air flow regulating flap.

17 Claims, 25 Drawing Sheets

(56) References Cited

U.S. PATENT DOCUMENTS

2012/0036902 A1 2/2012 Hong et al.

FOREIGN PATENT DOCUMENTS

| | | | |
|---|---|---|---|
| GB | 1 369 713 | | 10/1974 |
| GB | 2 159 932 | | 12/1985 |
| KR | 10-2006-0089073 | | 8/2006 |
| KR | 1020060089073 A | * | 12/2006 |
| KR | 10-2008-0010707 | | 1/2008 |

* cited by examiner

DRYER WITH AIR RECIRCULATION/HEAT EXCHANGE SUBASSEMBLY

FIELD OF THE INVENTION

The present invention relates generally to laundry dryers. In particular, the invention concerns a vented laundry dryer that employs air recirculation and/or heat exchange to achieve improved efficiency.

BACKGROUND OF THE INVENTION

During operation, a conventional vented tumble dryer draws air from the surrounding area, heats it, and directs it into the drum of the dryer. The dryer then exhausts the air and retained water vapor through a duct to the outside. As shown in FIGS. 1-3, a known vented dryer 10 generally includes a rotatable drum 12; an air supply duct 14 which introduces air from within the dryer housing or cabinet 16 into the drum 12; a heater 26 supplied at a heater tube portion of the air supply duct 14, which heats the air introduced into the air supply duct 14; and an air exhaust duct 18 to exhaust hot air and water vapor from the dryer, typically to a duct that exhausts the air to the outside of the house or other building in which the dryer is located. A fan or blower 20 is provided downstream of the drum 12 for drawing the air through the system and out the exhaust duct 18. A filter 22 for collecting lint and other debris in the air is placed between the drum 12 and the exhaust duct 18. In such a vented tumble dryer, the sole heat source is the heater 26 upstream of the drum 12. The only heat recovery that takes place is a slight warming of the air drawn into the cabinet 16 before it is drawn into heater 26, by virtue of the heat in the cabinet 16 generated by continued operation of the dryer 10.

Energy efficiency is an important aspect of a dryer, and improved heat recovery offers a valuable tool to improve overall energy efficiency. Some dryer system proposals use partially recirculated air in addition to the conventional heater to improve energy efficiency. These systems mix a portion of the exhaust air with the air being introduced into the drum. See, e.g., U.S. 2010/0146811. The warm, moisture laden exhaust air holds the potential to absorb additional molecules of water when recirculated through the dryer, and thus the heat energy of that air can be reutilized to improve operating efficiency.

However, maintaining the proper amount of recirculated air is important. If too much exhaust air enters the recirculation system, efficiency may decrease. Additionally, warm, moist recirculated air can escape into the dryer cabinet and potentially create condensation internal to the dryer unit, resulting in corrosion and other damage to the components. Some proposed recirculation systems control the amount of recirculated air flow by actively regulating and modulating flaps, dampers, baffles, and the like with, for example, central processing units, sensors, and manually adjustable devices. See, e.g., U.S. Pat. Nos. 5,315,765 and 7,434,333. Such systems can add substantial complexity and cost.

Another concern with using recirculated air is the potential fire hazard caused by lint and other debris that may remain in the recirculated air and be recirculated through the heater. Although most dryers have a standard lint filter, e.g., filter 22 of the dryer 10 shown in FIGS. 1-3, some lint may inevitably remain in the exhaust air flow. Recirculating a portion of this exhaust air back toward the heater poses the risk that accumulated lint may ignite in the heater and be carried into the drum. Thus, some recirculation system proposals include a secondary filter, positioned in the recirculation duct. See, e.g., U.S. 2010/0146811. Some proposed secondary lint filters are cleanable. For example, U.S. 2010/0146811 describes the use of internal scrapers, rinsing agents, rinsing liquids, and other methods of internally cleaning the secondary filter.

Energy efficiency may also be improved with various other methods of heat transfer used in combination with the recirculation system. For example, some laundry dryer proposals aim to improve heat energy transfer by utilizing a heat exchanger to transfer heat from the warm air exiting the exhaust air duct to the cooler air entering the supply air duct. See, e.g., U.S. Pat. No. 5,315,765.

However, prior proposals of dryers with air recirculation systems, or a combination of air recirculation and heat transfer, do not adequately address the practical problems of control, integration, and expense that can impede a successful implementation of these heat recovery techniques. There remains a need for an effective system that may fit and successfully operate within a known dryer design with little modification to existing structure. It would be highly advantageous to be able to provide an easily integrated recirculated air system for a dryer that can direct at least a portion of warm, moist exhaust air back toward the dryer supply duct, heater, and drum, to thereby effectively improve overall dryer efficiency. It would likewise be advantageous to provide such an easily integrated system further making effective utilization of air-to-air heat exchange, to further improve efficiency.

SUMMARY OF SELECTED INVENTIVE ASPECTS

Heat recovery from recirculation and/or heat exchange arrangements in accordance with aspects of the present invention can provide an economical, efficient, and practical alternative to conventional dryer air flow arrangements.

According to one aspect of this disclosure, a recirculation subassembly for a dryer is provided. The subassembly includes a recirculating conduit positioned at an angle between an exhaust duct and an air supply duct, to direct a portion of warm exhaust air back toward a drum of the dryer. Specifically, at least a portion of the warm air that would conventionally vent to the outside diverts through a recirculating conduit back to the supply duct upstream of the heater to mix with fresh intake air. The air mix then re-enters the heater, travels past the heater and through the drum, and again exits through the exhaust conduit, with a portion of the air again being recirculated.

According to another aspect of this disclosure, a heat exchanger is provided in thermal communication with both the air supply passage and the air exhaust passage. The air-to-air heat exchanger allows efficient transfer of heat energy from the warm exhaust air to the cooler supply air, and improves the dryer's ability to quickly and efficiently heat the air entering the drum. The heat exchanger may be used in conjunction with the recirculation aspects to further improve energy efficiency and heat recovery.

Another aspect of this disclosure concerns a passive control of air flow through the recirculation passage. If too much exhaust air enters the recirculation system, dryer efficiency may be decreased. Additionally, excess warm, moist air may undesirably backflow into the dryer cabinet and cause harmful condensation internal to the dryer unit. Thus, embodiments described herein control airflow through the sizing, arrangement, and configuration of various air flow and recirculation components.

For example, a sharp angle or switchback feature of the recirculation passage relative to the airflow through the exhaust passage can help control the amount of air entering the recirculation passage. One or more flaps may be provided within the recirculation subassembly to direct and/or regulate the flow of recirculated air, to thereby provide an optimal ratio of fresh air to recirculated air, and thus prevent a backflow of recirculated air, air stagnation, and/or air resistance due to opposing flows. Further, the duct cross-sections may be set so that the exhaust duct/passage has a larger controlling cross-section than the recirculation duct/passage to help ensure the proper proportion of air is recirculated.

In an embodiment, the recirculation passage connects a relatively low static pressure air supply conduit and a relatively high static pressure air exhaust conduit. The pressure differential exists by virtue of the dryer configuration, including the location of the blower in the circuit (e.g., downstream of the drum and adjacent the air exhaust passage), and causes a portion of the exhaust air to be sucked into the recirculation passage. The recirculated air flow is regulated so as not to be excessive as a result of this pressure differential. For example, the passage components may be configured such that the recirculation airflow rate is approximately equal to the fresh intake air flow rate (1:1 ratio).

Another aim of aspects of the present invention is to provide a modular recirculated air flow system that can be easily integrated within conventional vented dryers, including at the point of manufacture or as a post-production improvement. Moreover, the components could constitute a kit for retrofitting an existing dryer.

The above and other objects, features, and advantages of the present invention will be readily apparent and fully understood from the following detailed description of preferred embodiments, taken in connection with the appended drawings.

BRIEF DESCRIPTION OF THE DRAWINGS

Non-limiting embodiments of the present invention will now be described, by way of example, with reference to the accompanying drawings, in which.

DETAILED DESCRIPTION OF EXAMPLE EMBODIMENTS

Figure 1:
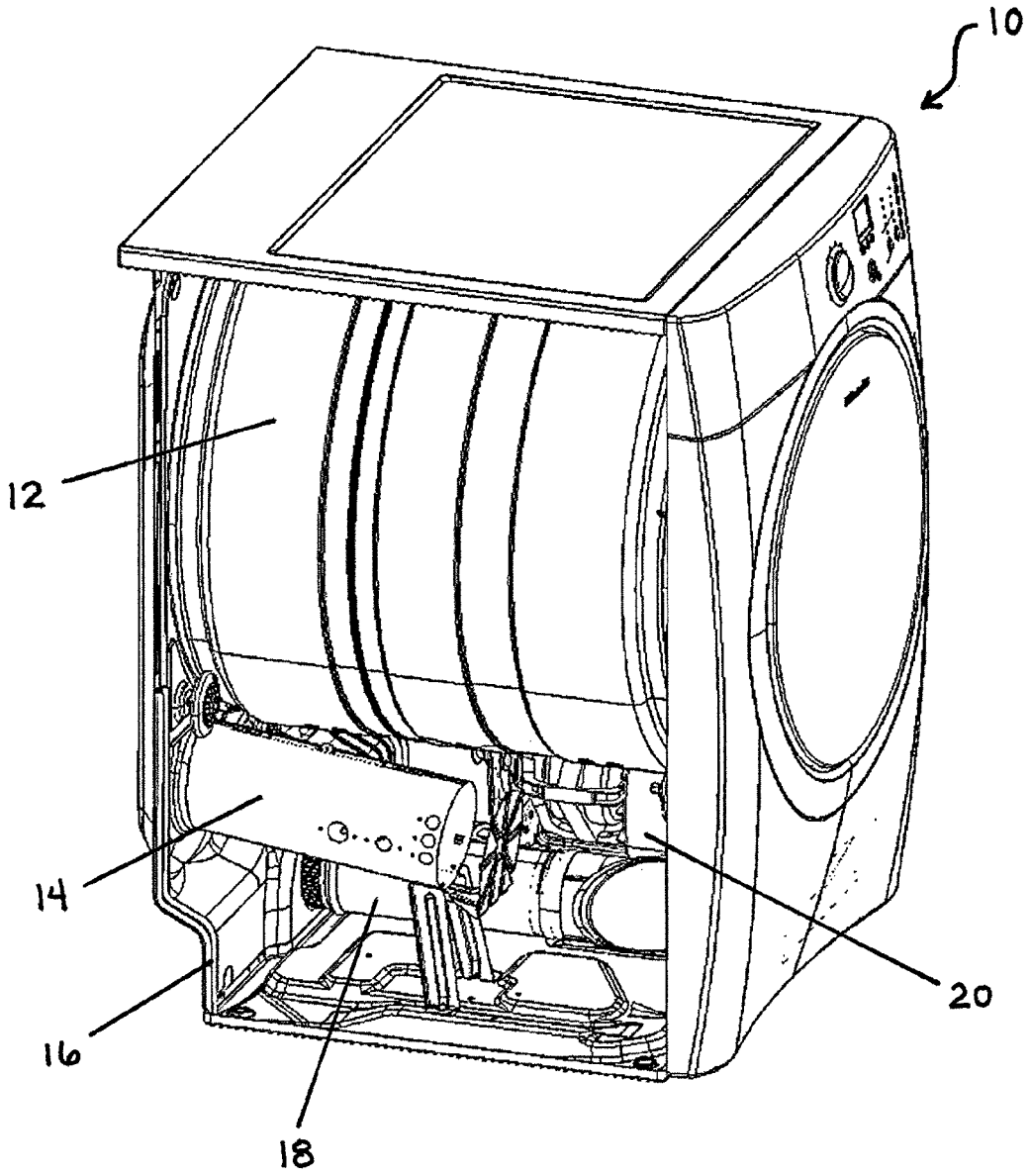
FIG. 1 Prior Art
FIG. 1 shows a side perspective view of a conventional vented tumble dryer, with a portion of the dryer housing removed to illustrate internal components related to aspects of this invention.

FIGS. 5-17 illustrate a vented tumble dryer 100 with an air recirculation subassembly 120 for driving a portion of warm exhaust air back toward the drum 102 of the dryer 100. In the embodiment illustrated, the recirculation subassembly 120 includes tubing/ductwork forming an air supply passage 122, air exhaust passage 124, air recirculation passage 126, and flow directing flap 130 (see FIGS. 9-10).

Figure 4:
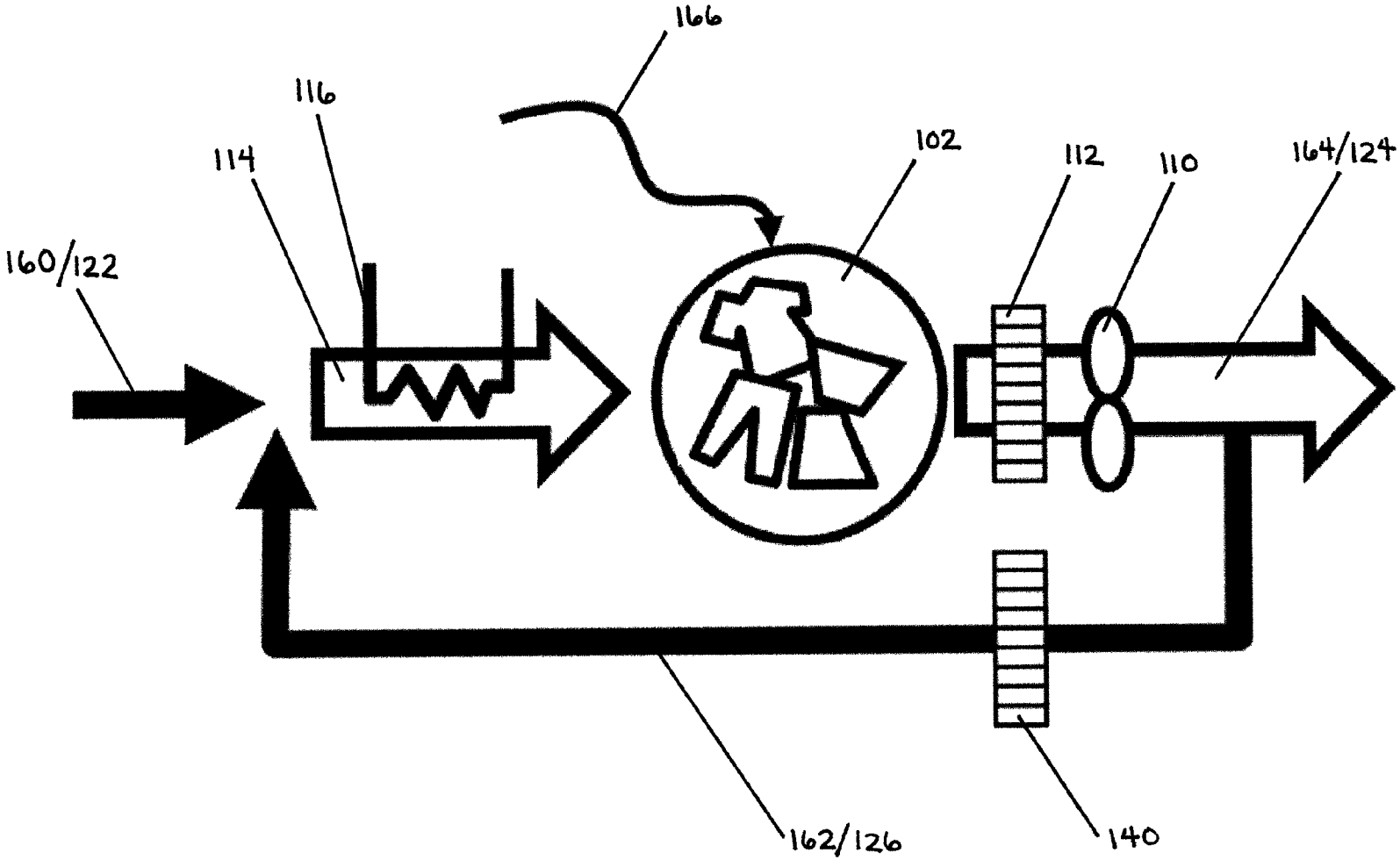
FIG. 4 is a schematic diagram of a dryer provided with air recirculation in accordance with aspects of the invention.
Figure 5:
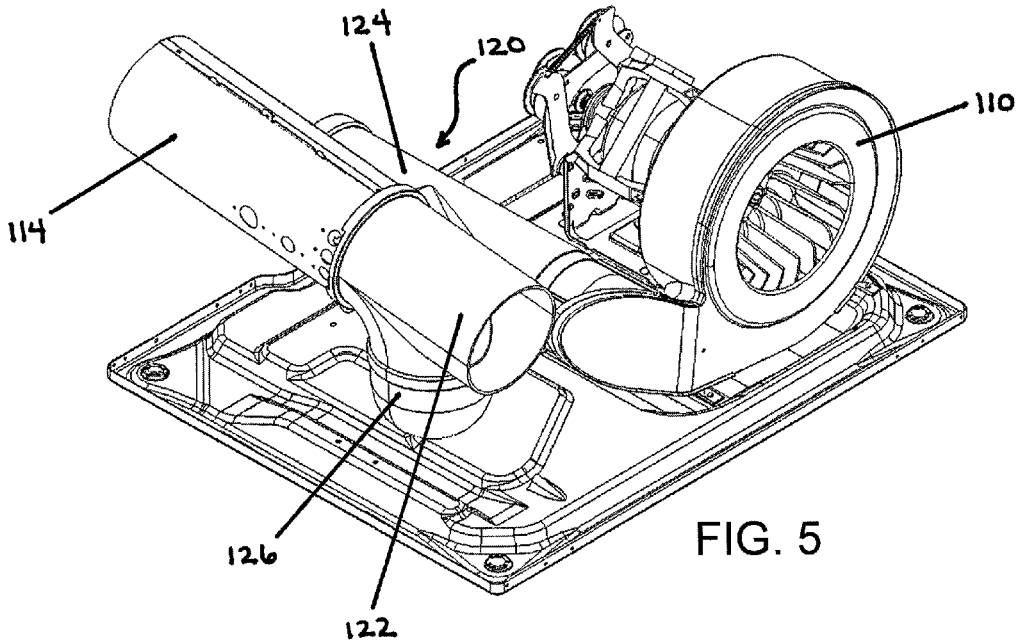
FIG. 5 shows a front perspective view of a dryer basement portion including air flow and related components for providing air recirculation in accordance with aspects of the invention.

FIG. 4 schematically illustrates an air flow circuit, including air recirculation, of dryer 100. Fresh air 160, which is, as shown, air drawn from within the dryer cabinet 106, enters the air supply tube 122, travels through the heater tube 114 across the heater 116 (which may comprise multiple heating elements), and through a manifold 118 at a rear side of the dryer 100 (see FIG. 8) into the drum 102. The air is then pulled past a conventional lint filter 112 and into the air exhaust tube 124. The air flow is generated by a known type (e.g., centrifugal) fan/blower 110, operating in a suction mode downstream of drum 102. Prior to exiting the air exhaust tube 124, a portion of the warm, typically moist exhaust air 164 is diverted into an air recirculation passage 126. The recirculated air 162 travels through the air recirculation channel 126 back to the air supply tube 122 upstream of the heater tube 114. Upon re-entering the air supply passage 122, the recirculated air 162 combines with the intake air 160 entering the air supply tube 122. The air mix then continues into the heater tube 114, and the process repeats.

The recirculation subassembly 120 is fitted between the inlet of the heater tube 114 and the outlet of the fan/blower 110 of the dryer 100. In accordance with an aspect of the invention, heater tube 114 and fan 110 are known components arranged in the known manner shown in FIGS. 1-3. The recirculation passage 126 fluidly connects the air exhaust passage 124 downstream of the fan 110 to the air supply passage 122 upstream of the heater tube 114. In an installed orientation, the air recirculation channel 126 extends upwardly from its point of connection to the exhaust channel 124 to its point of connection to the inlet channel 122. As such, the connecting part of the heater tube 114 and/or air supply passage 122 may be positioned at a greater height than the exhaust conduit 124, e.g., with respect to the floor of the dryer 100, as illustrated in FIGS. 5-17. Moreover, these components may be wholly contained in the space below the drum, as will be described further.

Figure 6:
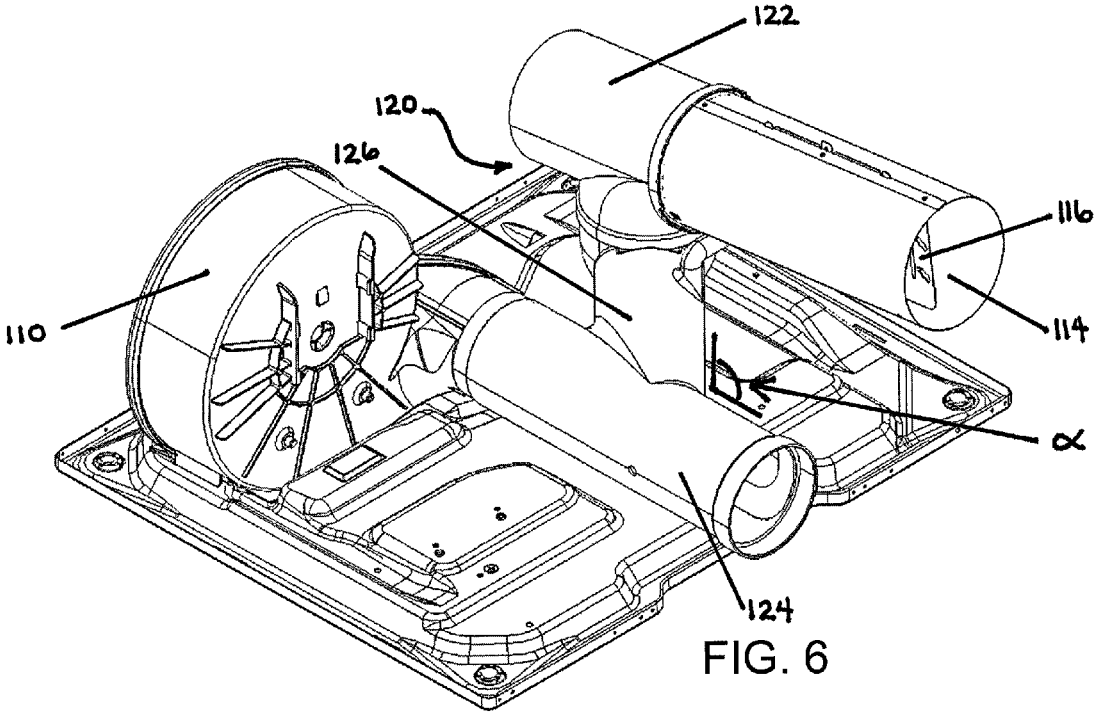
FIG. 6 shows a rear perspective view of the dryer basement portion shown in FIG. 5.
Figure 7:
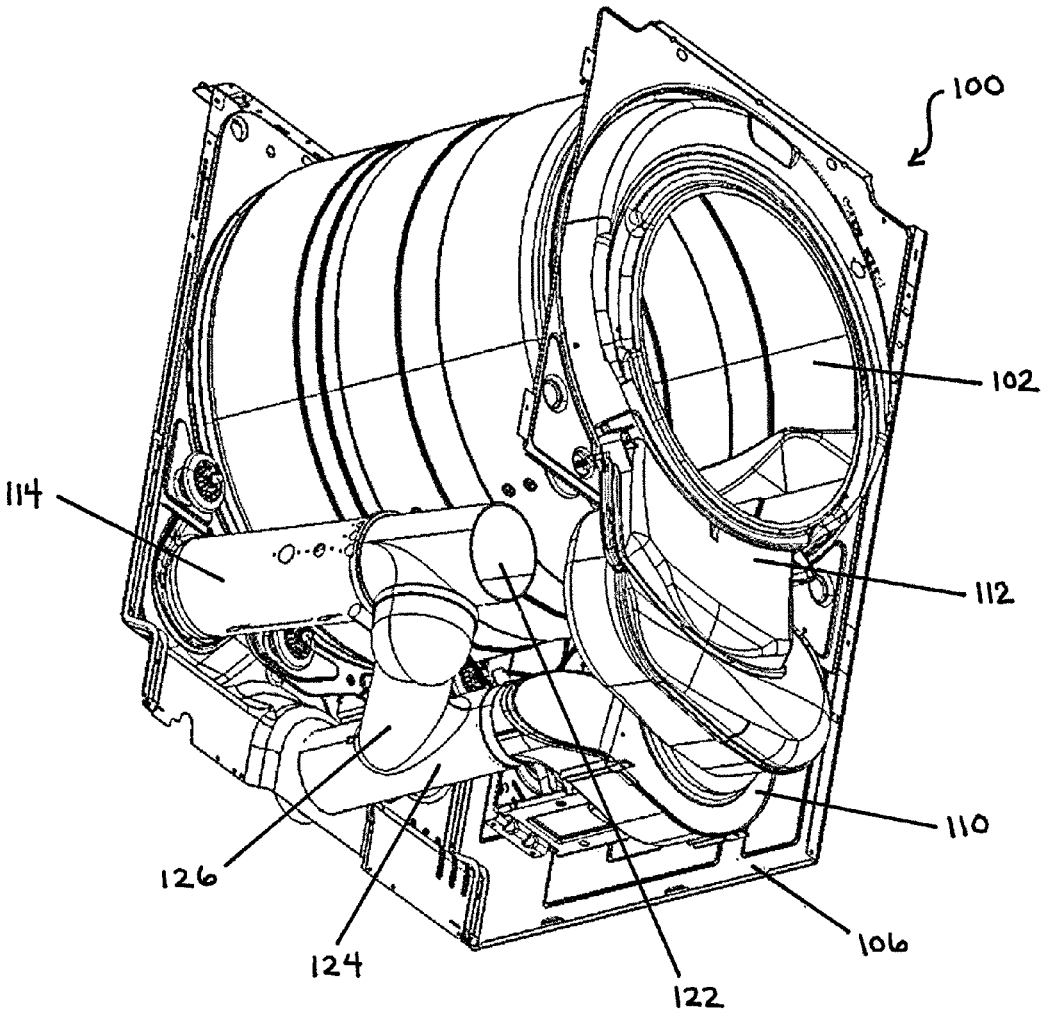
FIG. 7 shows a bottom-front perspective view of a dryer, with portions of the dryer housing removed to reveal internal components thereof, including components of the basement portion shown in FIG. 5.

As shown in FIG. 6, in the illustrated embodiment, the recirculation passage 126 connects to the exhaust conduit 124 at a relatively large angle $\alpha$ relative to the direction of the air exhaust flow 164. The large switchback or angle $\alpha$ limits the influence of dynamic pressure on the amount of air entering the recirculation passage 126. In the embodiment shown in FIG. 6, the switchback angle $\alpha$ of the recirculation passage 126 relative to the air exhaust outflow direction is 135 degrees. The switchback angle $\alpha$ may range from 90 degrees to close to 180 degrees. With an angle $\alpha$ of at least 90 degrees, the velocity of the airflow in the exhaust direction will not contribute dynamic pressure to increase the overall pressure differential between the exhaust side and the inlet side of the air recirculation passage 126. In other embodiments, only a connecting portion of the air recirculation passage 126, that connects with the exhaust conduit 124, extends at an angle of at least 90 degrees relative to a flow direction of the air exhaust passage extending past the connecting portion.

The static pressure differential between the inlet and outlet sides of the air recirculation passage 126 also is largely determinative of the amount of air 162 recirculated through the recirculation passage 126 of the recirculation subassembly 120. It is to be noted that due to the placement of the process fan/blower 110 operating in suction mode downstream of the drum 102, the relatively low pressure generated in the drum 102 draws additional air 166 through the non-airtight drum 102 and into the flow, as depicted by arrow 166 in FIG. 4. Thus, the air flow on the high pressure downstream side of fan 110 may be substantially, e.g., 50% to 80%, greater than the flow on the upstream side of drum 102. This higher flow rate and the static pressure differential between the relatively high pressure exhaust passage 124 and the relatively low pressure supply passage 122 make it essential to regulate the recirculation air flow 162 so as to avoid recirculation of an excessive amount of air. Recirculation of an excessive amount of air has undesirable consequences. First, it can result in a backflow of air out of the air supply passage 122 and into the cabinet 106. If warm moist recirculated air escapes into the dryer housing 106, it can cause harmful condensation internal to the dryer housing 106. The counter-flow of air would also undesirably reduce the intake air flow rate, thus adversely affecting drying efficiency.

Moreover, recirculation of an excessive amount of air through the drum 102 can adversely impact drying efficiency due to excessive moisture in the air. Thus, the volumetric rate of recirculated air flow 162 through the recirculation passage 126 is regulated relative to the volumetric rate of the intake air flow 160. In a preferred embodiment, the ratio of recirculated air to fresh inlet air is approximately 1:1. In other embodiments, the ratio of recirculated air to fresh inlet air may vary, ranging, e.g., from 0.8:1 to 1.2:1. A higher ratio, e.g., greater than 1.2:1, may result in some condensation inside the cabinet 106 due to air losses or backflow. However, such a higher ratio may be helpful to improve dryer performance in the case of a small laundry load.

In accordance with aspects of the invention, the sizing of components may be used to control the direction and amount of recirculation airflow. For example, as in the illustrated embodiment of FIGS. 5-17, the controlling (i.e., minimum) cross-section of the air recirculation channel 126 can be made smaller than the controlling cross-section of the air exhaust passage 124. For example, the minimum cross-section of the air recirculation channel 126 may be 20% to 90% smaller than the minimum cross-section of the air exhaust tube 124 in order to control the amount of recirculation air entering the recirculation channel 126 as compared to the fresh air entering through intake tube 122.

Additionally, in the illustrated embodiment, a flap 130 (see FIGS. 9-11) is provided to help direct the recirculation air flow 162 toward the heater tube 114 along with the fresh inlet air flow 160 from the supply passage 122. The flap 130 helps avoid air stagnation or backflow, by deflecting the recirculation air 162 to flow with, rather than against, the flow direction of the fresh inlet air 160. This also promotes the mixing of the fresh air 160 and recirculated air 162 upstream of the heater tube 114. Especially given the close proximity of the air inlet 122, flap 130 is important to prevent backflow and unwanted air losses into the cabinet.

As illustrated, the flow directing flap 130 is provided at the junction of the air recirculation passage 126 and the air supply passage 122. It is inclined upwardly relative to the flow direction of passage 122, e.g., by 30°-60° (approximately 45° as illustrated) and extends partially over the adjoined outlet of recirculation passage 126. In some embodiments, the flow directing flap 130 may be integrally molded with the tubing/ductwork forming air supply passage 122, the tubing/ductwork forming the air recirculation passage 126, and/or both by, for example, injection molding. In other embodiments, the flow directing flap 130 may be a separate part mounted or attached to one or both of the components forming the air supply passage 122 and the air recirculation passage 126. In embodiments where flap 130 is a non-integrally molded, separate part, the flap 130 may be ultrasonic welded, spot welded, or otherwise attached or incorporated in a manner generally known in the art. Additional flaps may be provided within the recirculation passage 126 in alternate embodiments.

Figure 10:
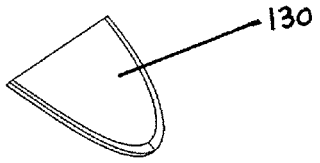
FIG. 10 is a perspective view showing, in isolation, the air flow directing flap seen in FIG. 9.
Figure 11:
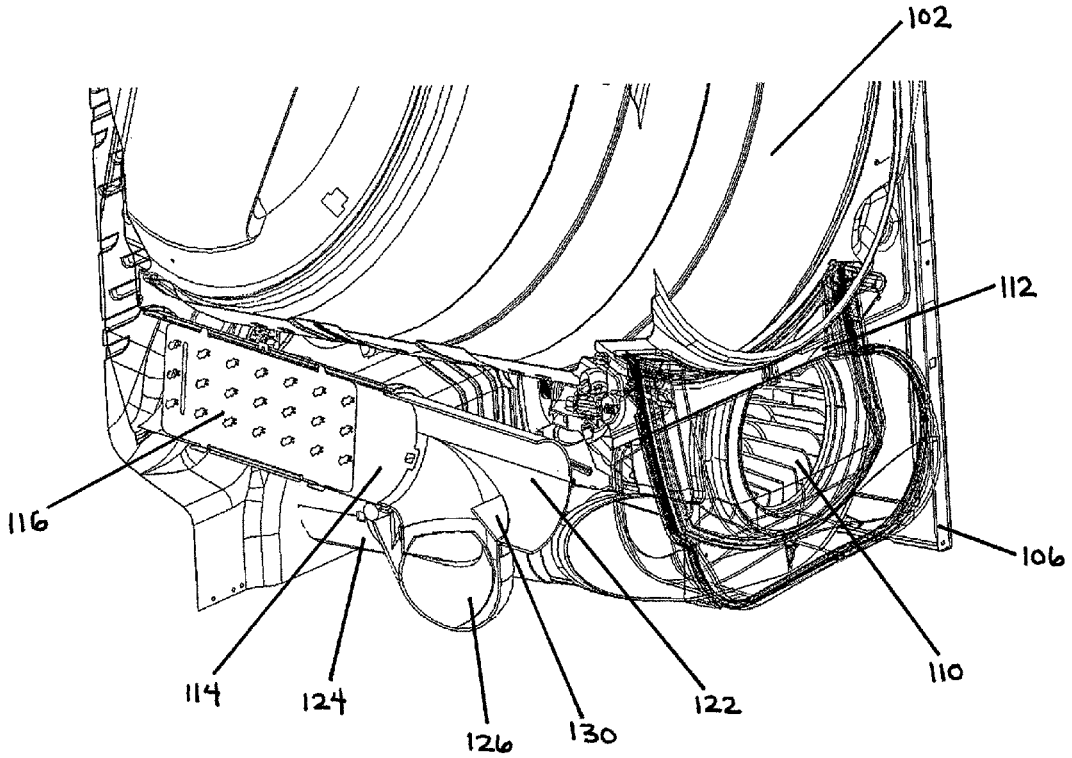
FIG. 11 is a partial perspective cross-sectional view showing the flap of FIG. 10 in an installed position within the dryer of FIG. 7 (some components depicted in wire-frame).
Figure 12:
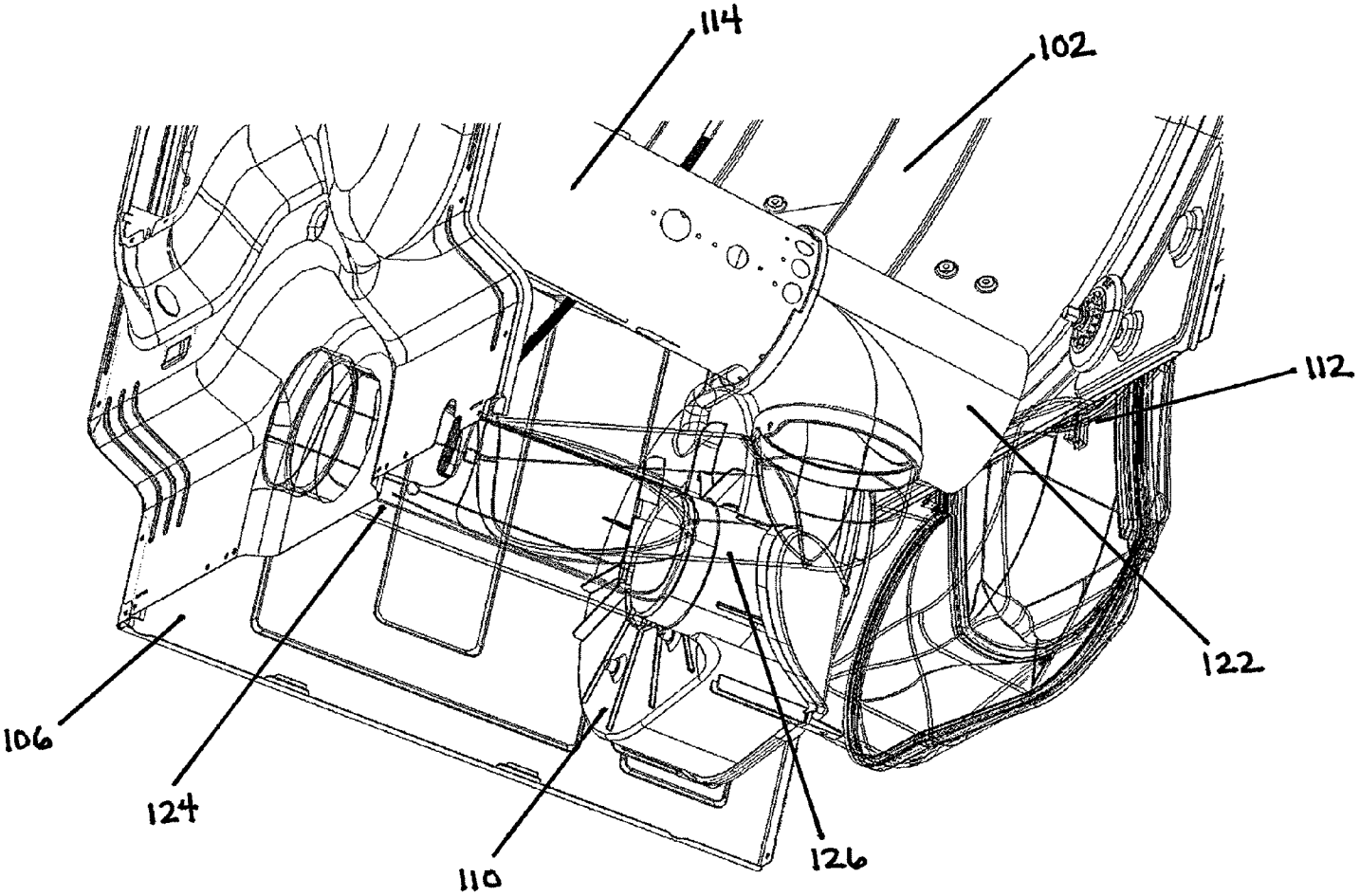
FIG. 12 is a partial bottom perspective view of the dryer of FIG. 7, with cabinet panels removed to reveal recirculation and air flow components thereof (some components depicted in wire-frame).
Figure 13:
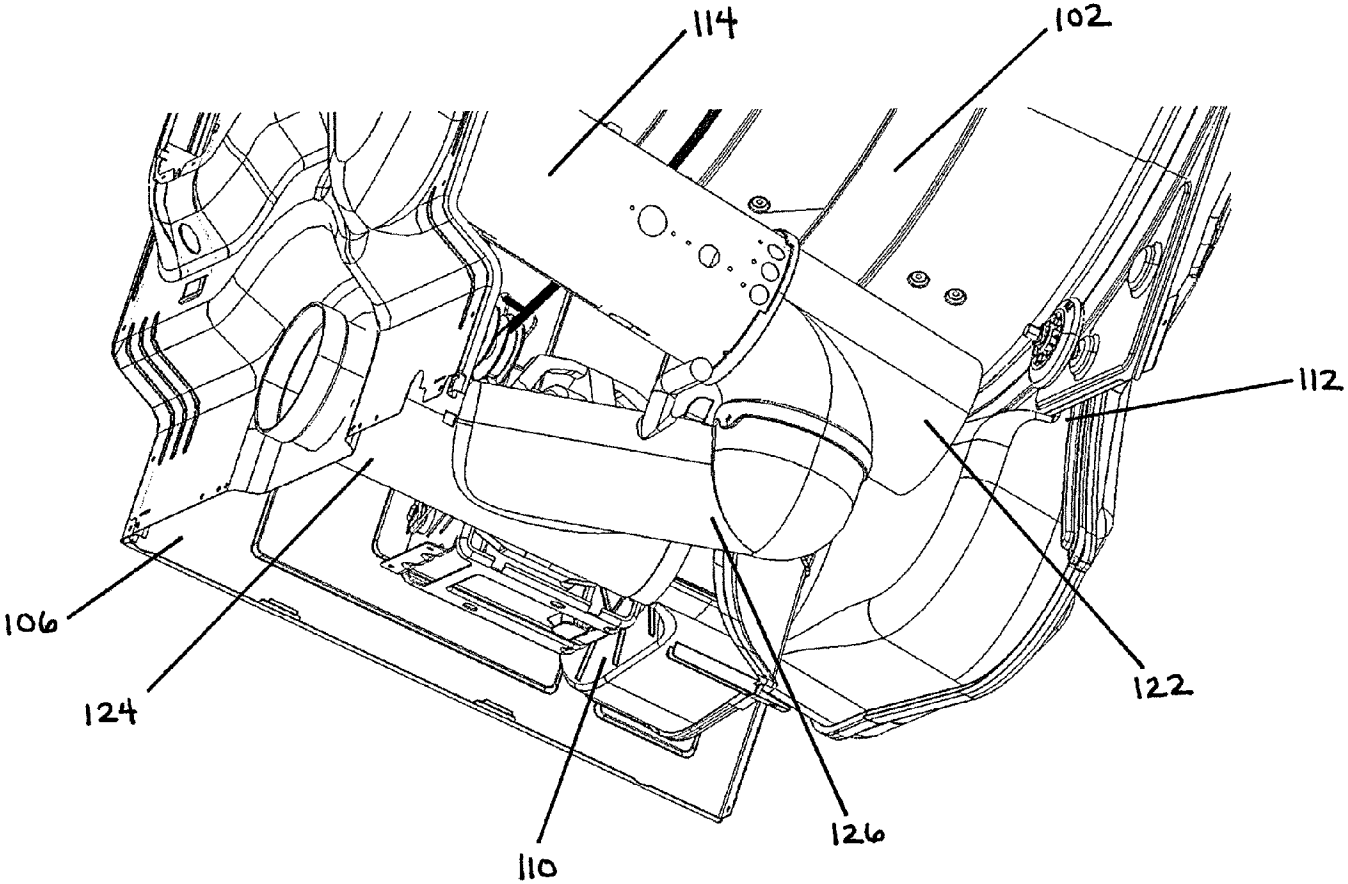
FIG. 13 is a partial bottom perspective view similar to FIG. 12 (without wire-frame depictions).

As best seen in FIG. 10, the flap 130, depicted in isolation, has a semi-circular shape or an arched periphery designed to fit flushly within the lower portion of air supply passage 122 so as to not allow air to flow through or around the flap. Other geometries are possible. The flap 130 may be of the same material as the conduits/tubes 122, 124 and 126, e.g., plastic or galvanized sheet metal, or other materials able to withstand over time a warm, humid laundry dryer environment.

Figure 15:
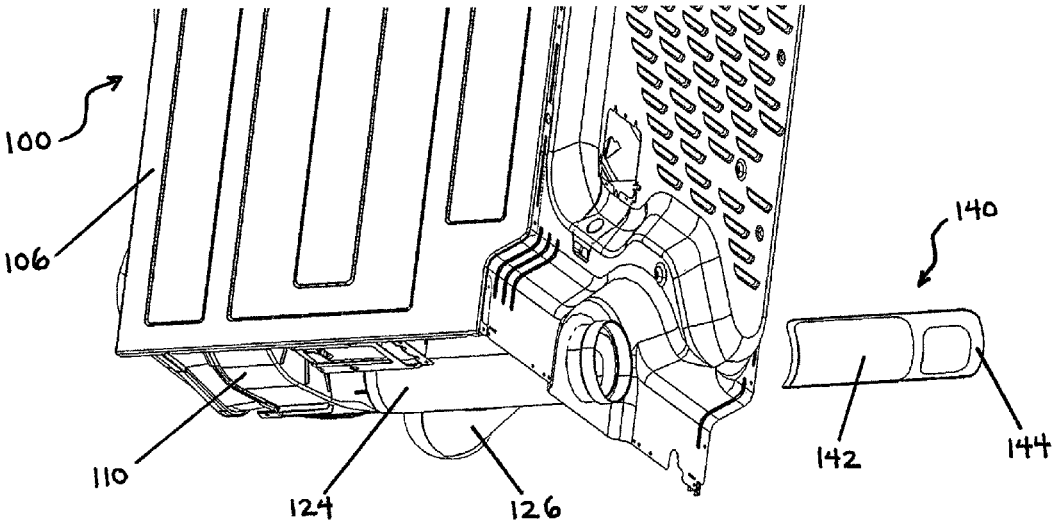
FIG. 15 is a partial perspective view of the dryer of FIG. 7, and showing a recirculation air lint filter in a removed position in accordance with an aspect of the invention.
Figure 16:
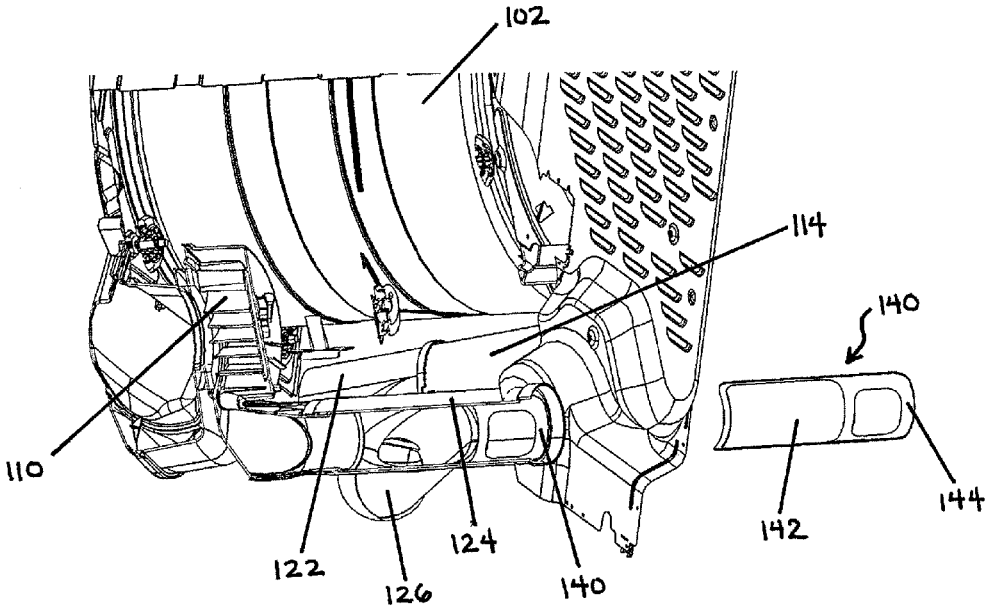
FIG. 16 is a partial perspective view like FIG. 15, but in partial cross-section to reveal the mounting location of the recirculation filter.
Figure 17:
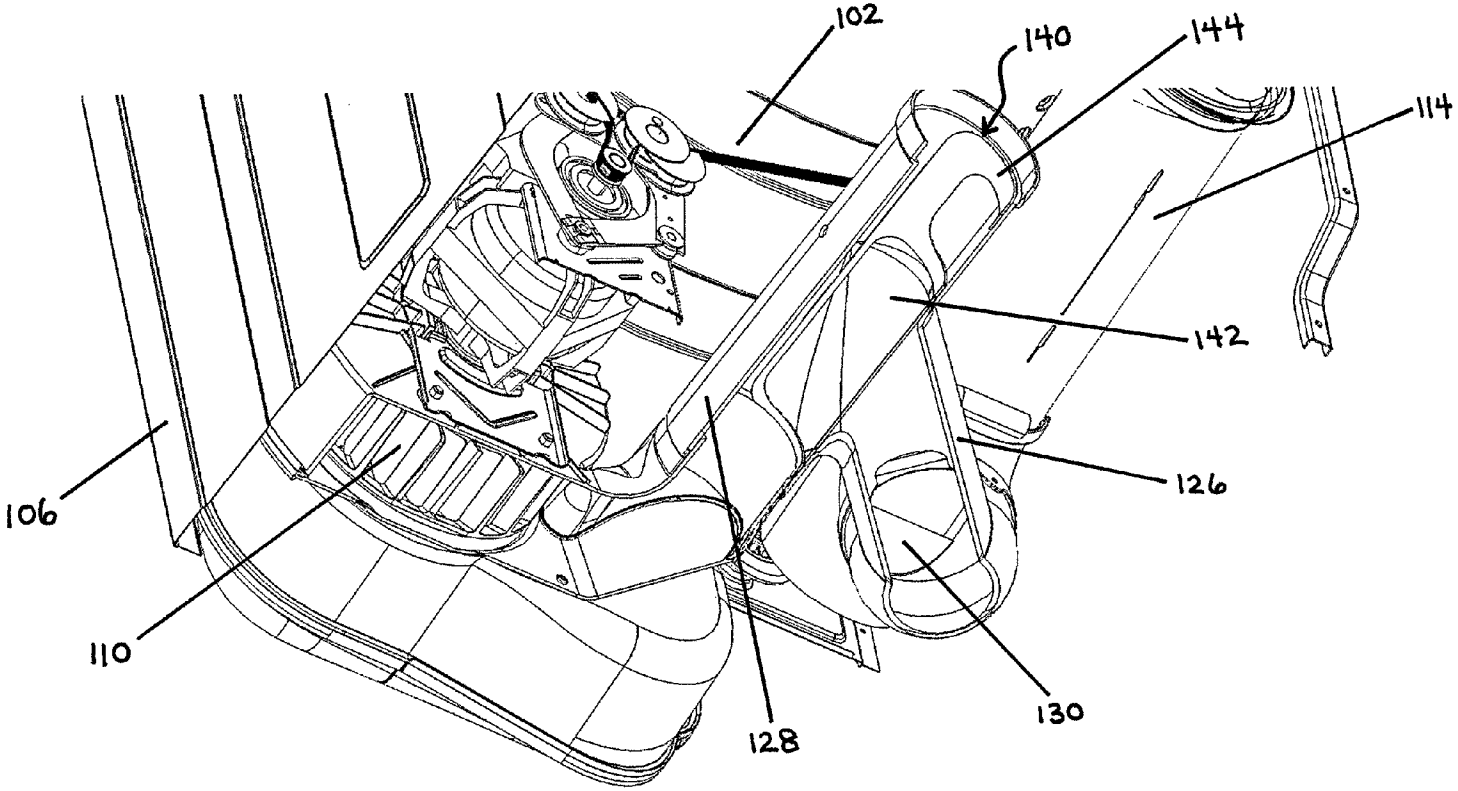
FIG. 17 is a partial bottom perspective view of the dryer of FIG. 7, partially in cross-section to reveal interior structure of airflow conduits.

As shown in FIGS. 15-17, the illustrated embodiment of the air recirculation subassembly 120 also includes a recirculation air filter 140 mounted within the exhaust tube 124 and extending across the junction between the exhaust tube 124 and the recirculation conduit 126. This filter 140 aids in the removal of lint and debris potentially remaining in the exhaust air 164 traveling downstream from the drum 102 after passage through conventional lint filter 112. The filter 140 may include a filter element portion 142 and frame portion 144. The filter 140 may be installable and removable from the dryer 100 through the exhaust passage 124 as shown in FIGS. 15-16, e.g., for cleaning or replacement. In the illustrated embodiment, the frame portion 144 provides a handle that a user may grasp in order to remove, replace, and/or install the filter 140. In alternative embodiments, the filter 140 may be positioned in other locations, such as within the air recirculation passage 126 and/or in the exhaust passage 124 upstream of the recirculation passage junction. The filter 140 may be configured to serve a flow regulating function, for example, by providing constricted airflow passageways and/or an air filter element inherently providing a degree of airflow resistance.

Figure 2:
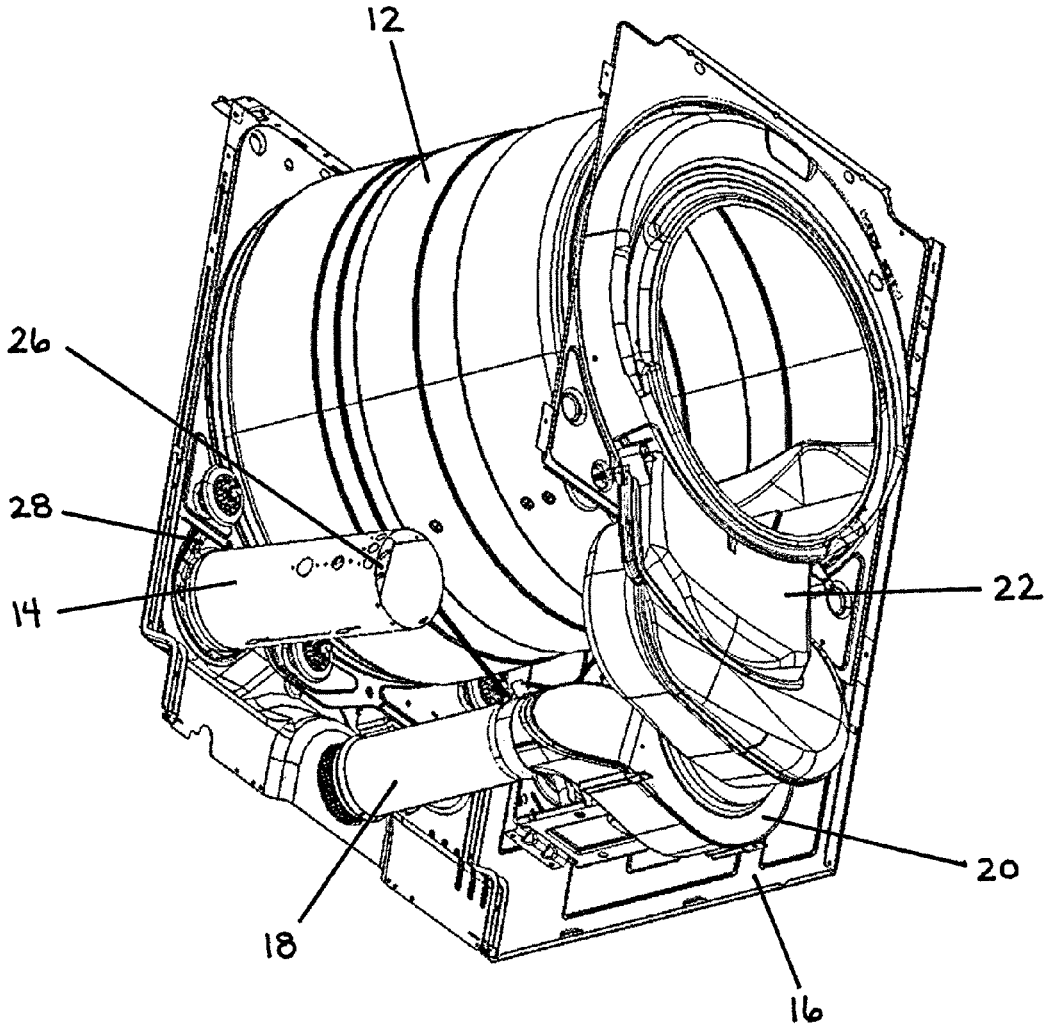
FIG. 2 Prior Art
FIG. 2 shows a bottom-front perspective view of the conventional dryer shown in FIG. 1, with cabinet panels removed to reveal internal operating and air flow components.
Figure 3:
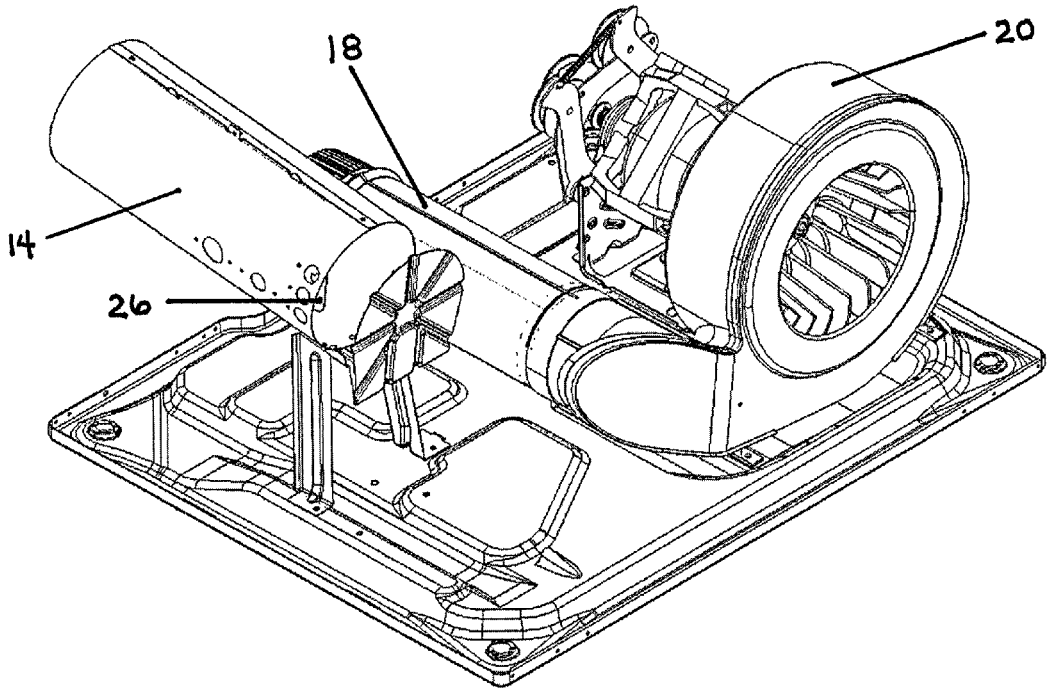
FIG. 3 Prior Art
FIG. 3 shows a perspective view of a dryer basement portion, including the primary internal air flow components of the conventional dryer shown in FIG. 1.

Advantageously, the recirculation subassembly 120 may be modularly integrated within a known-type vented tumble dryer 10 as shown in FIGS. 1-3, with few modifications to the existing structure. This could be done at the time of manufacture, or as a retrofit to an existing appliance. For example, the recirculation subassembly 120, including air supply tube/passage 122, air exhaust tube/passage 124, air recirculation tube/passage 126, flow directing flap 130, and recirculation filter 140, may replace the conventional exhaust tube 18 (FIGS. 1-3) and be fitted onto the conventional heater tube 114 on one end and to the outlet of fan/blower 110 on the other, within the space below the drum 102 (corresponding to drum 12 of the known dryer 10 of FIGS. 1-3).

Figure 8:
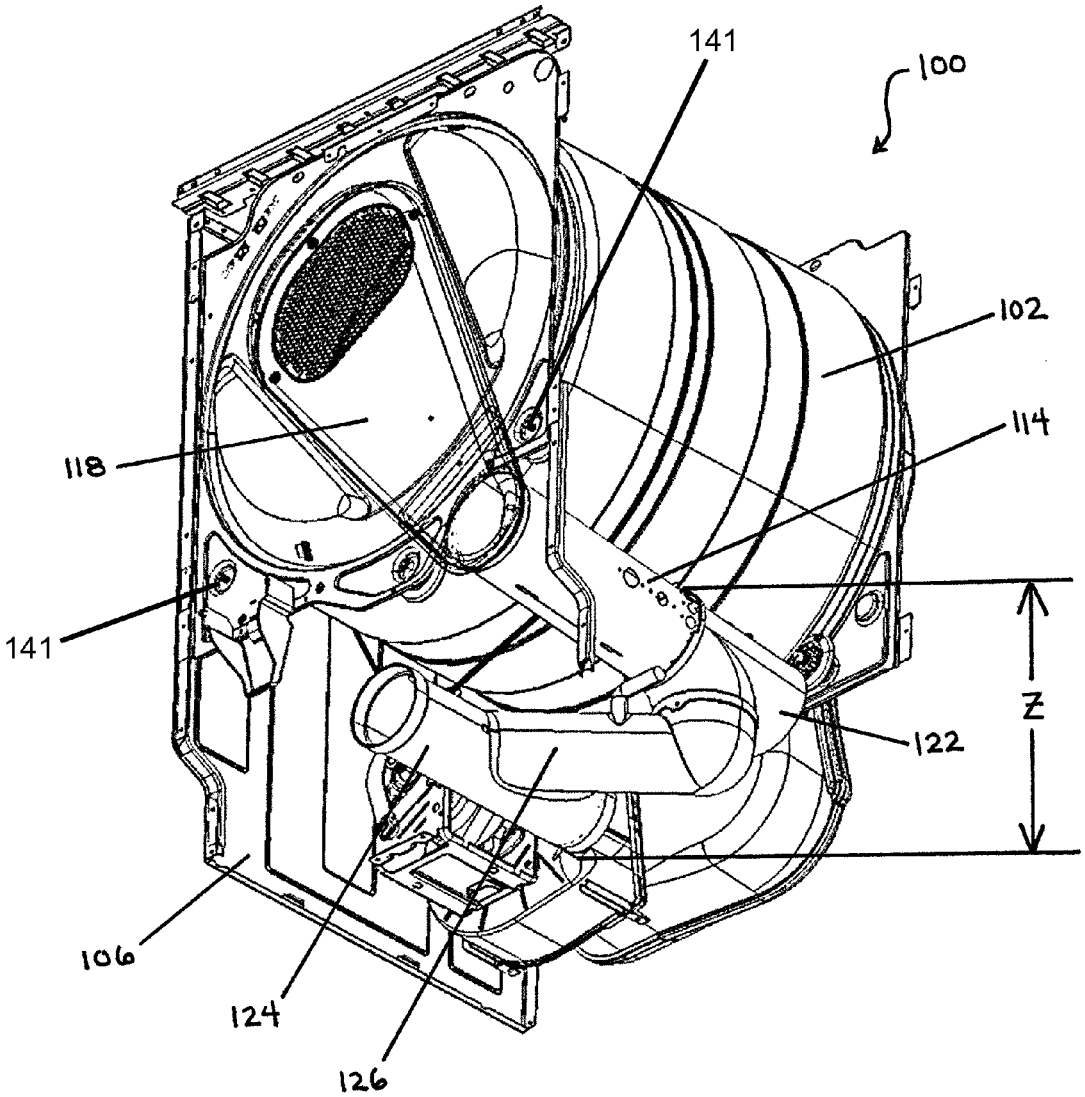
FIG. 8 shows a bottom-rear perspective view of the dryer of FIG. 7, with portions of the dryer housing removed.
Figure 9:
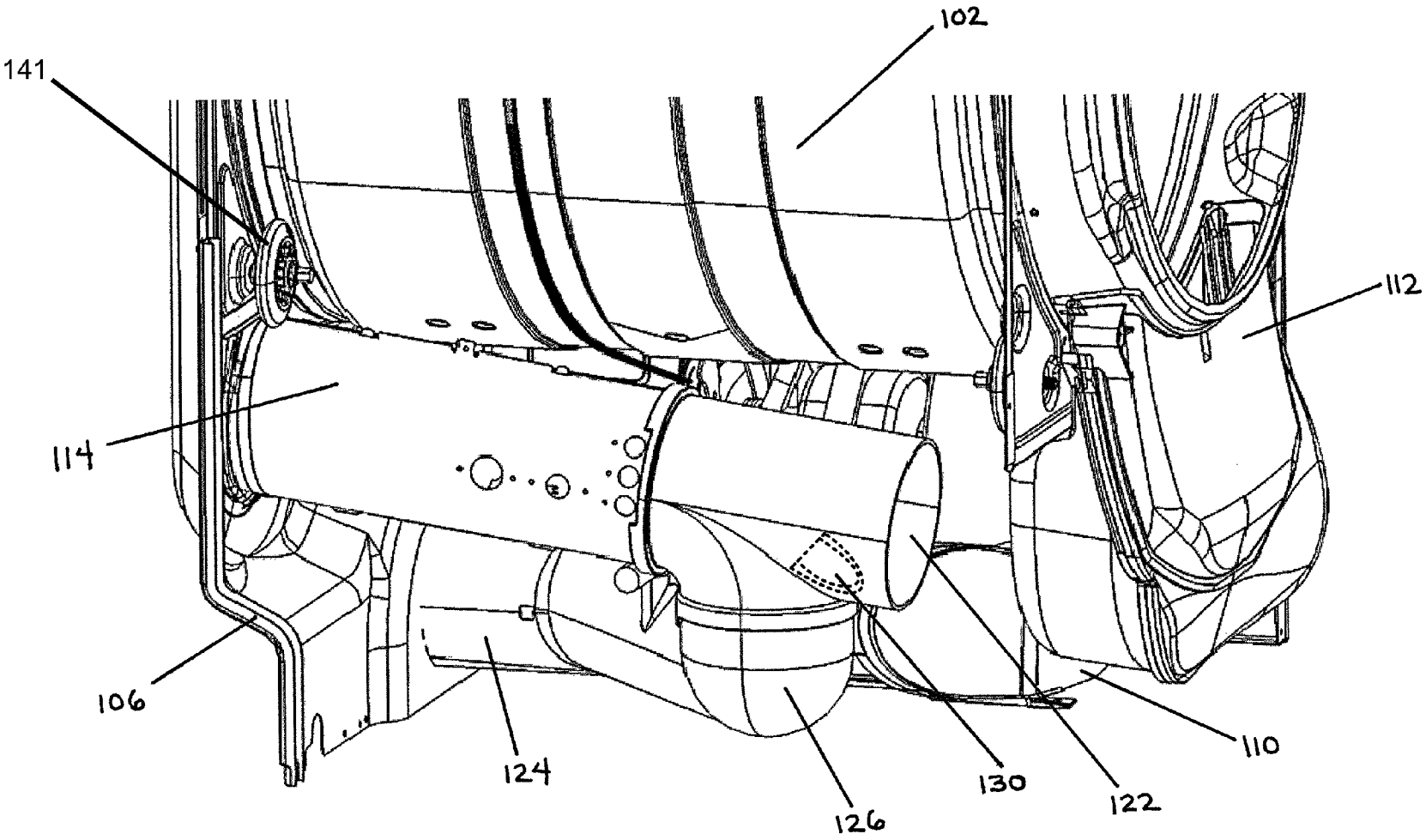
FIG. 9 is a partial side perspective view of the dryer of FIG. 7, showing aspects of the inventive recirculation subassembly, including an air flow directing flap thereof.

The recirculation subassembly 120 is configured to fit within a basement portion of the cabinet 106 below the drum 102. By "below the drum," it is meant at least below an upper half of the drum, and preferably below the level of the pair of lower side support rollers of the drum 102, such as 141 seen in FIG. 9. (A like roller 141 is at the same level on the opposite side, as seen in FIG. 8.) In some embodiments, the recirculation subassembly 120 will fit entirely beneath the level of the lower-most central point of the drum.

Figure 14:
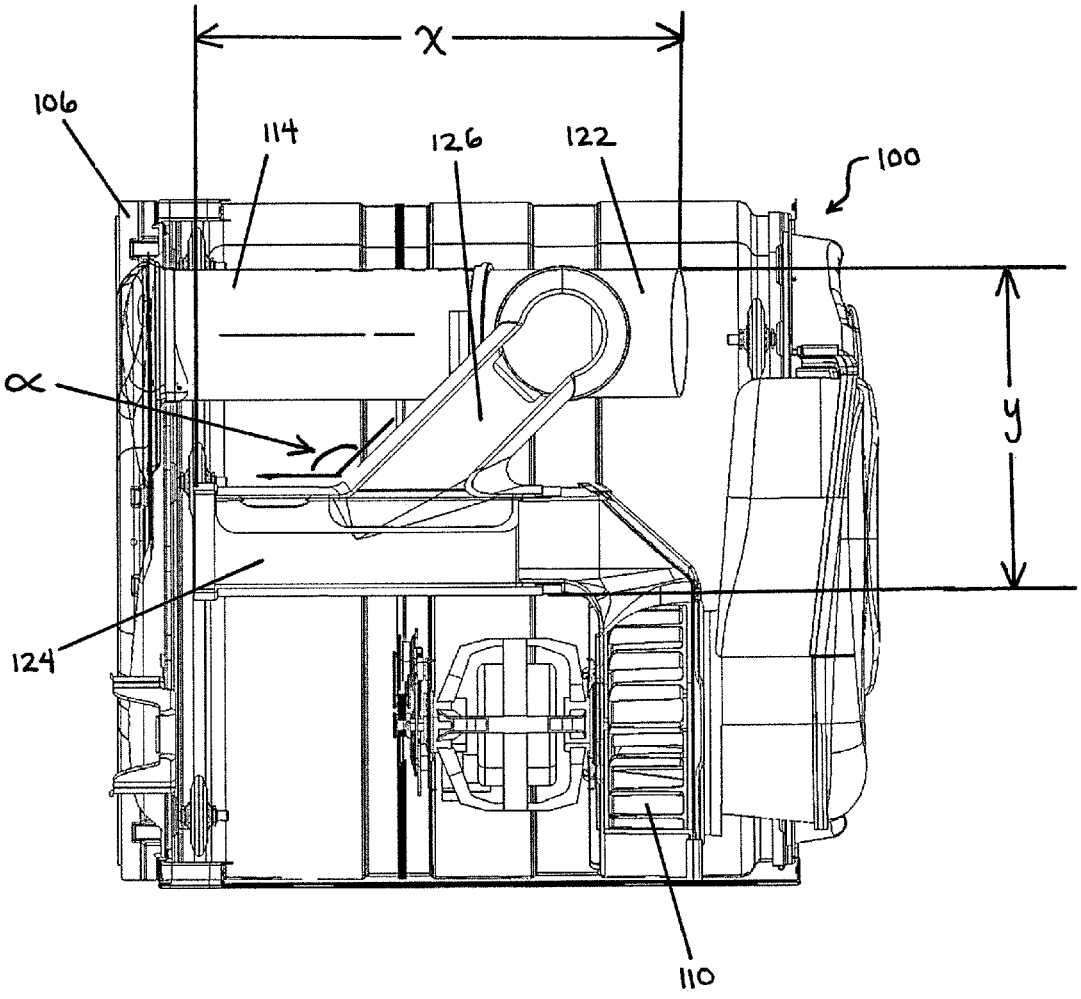
FIG. 14 is a bottom plan view of the dryer of FIG. 7, with the bottom cabinet panel removed to reveal internal components.

For usefulness in fitting within such a space of a range of known dryers, the recirculation subassembly 120 may have a maximum depth dimension X up to approximately 31" (787 mm), a maximum width dimension Y up to approximately 27" (686 mm), and a maximum height dimension Z of up to approximately 20" (508 mm), as shown in FIGS. 8 and 14. More preferably, these dimensions X, Y, and Z would be no greater than approximately 27.5" (700 mm), 16" (400 mm), and 16" (400 mm), respectively. In the exemplary embodiment illustrated in FIGS. 8 and 14, configured to fit within the known dryer of FIGS. 1-3, the dimensions X, Y, and Z are approximately 18" (460 mm), 10" (260 mm), and 14" (350 mm), respectively.

With reference to FIGS. 1-3, the heater tube portion of the air intake tube 24, heater 26, manifold 28, drum 12, primary lint filter 22, and fan 20 do not need to change or move in order to integrate the recirculation subassembly 120 as illustrated in FIGS. 4-17. Thus, the recirculation subassembly 120 may be added to existing dryers or integrated into existing dryer designs to improve energy efficiency with little modification to existing parts.

Figure 18:
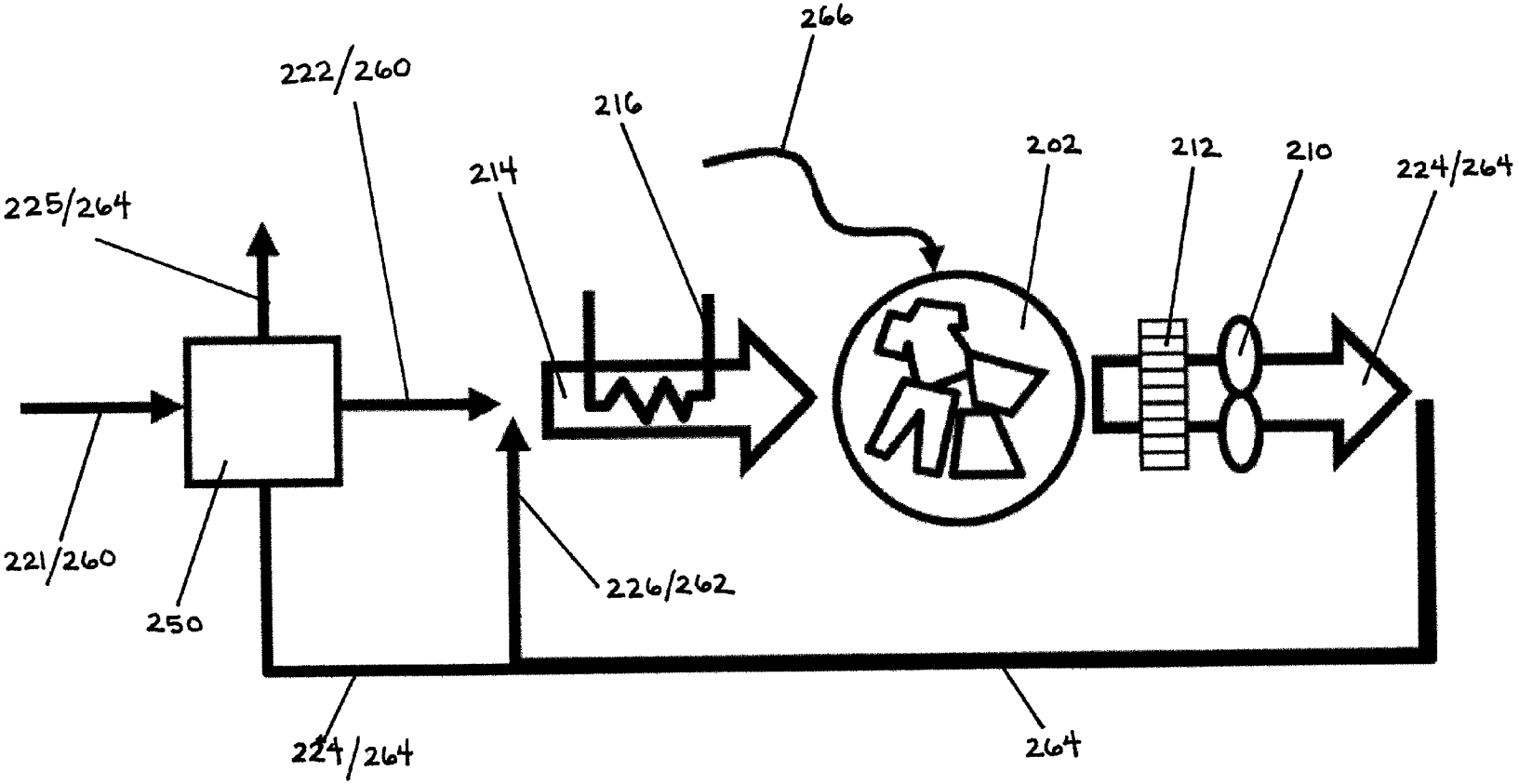
FIG. 18 is a schematic diagram showing the air flow and related major components of a second dryer embodiment, including air-to-air heat exchange in addition to air recirculation.
Figure 19:
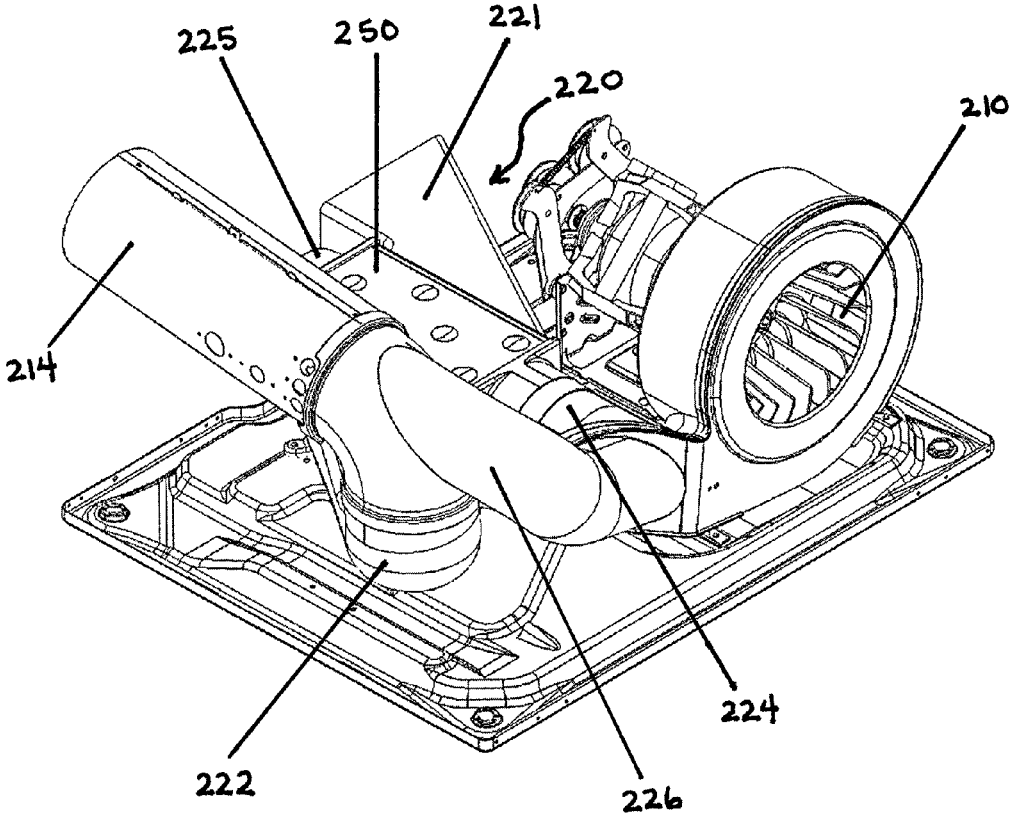
FIG. 19 shows a front perspective view of a dryer basement portion, including air flow and related components of the second embodiment, in accordance with further aspects of the invention.
Figure 20:
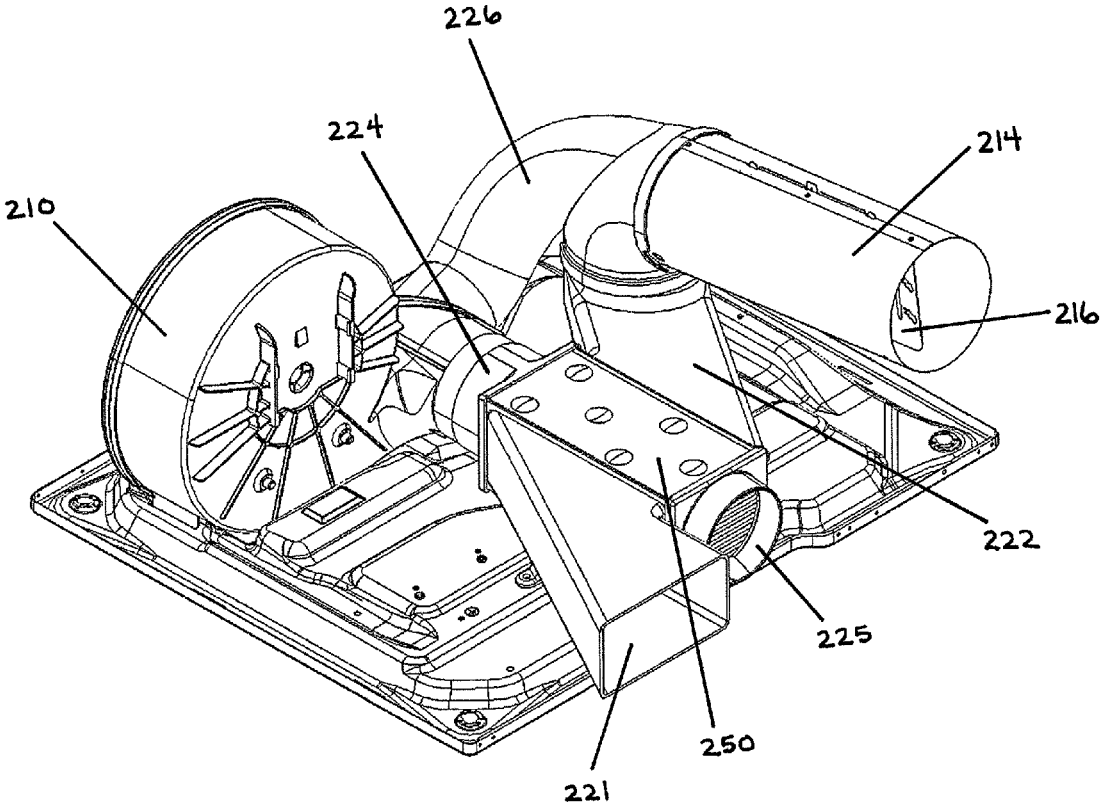
FIG. 20 shows a rear side perspective view of the dryer basement portion illustrated in FIG. 19.
Figure 21:
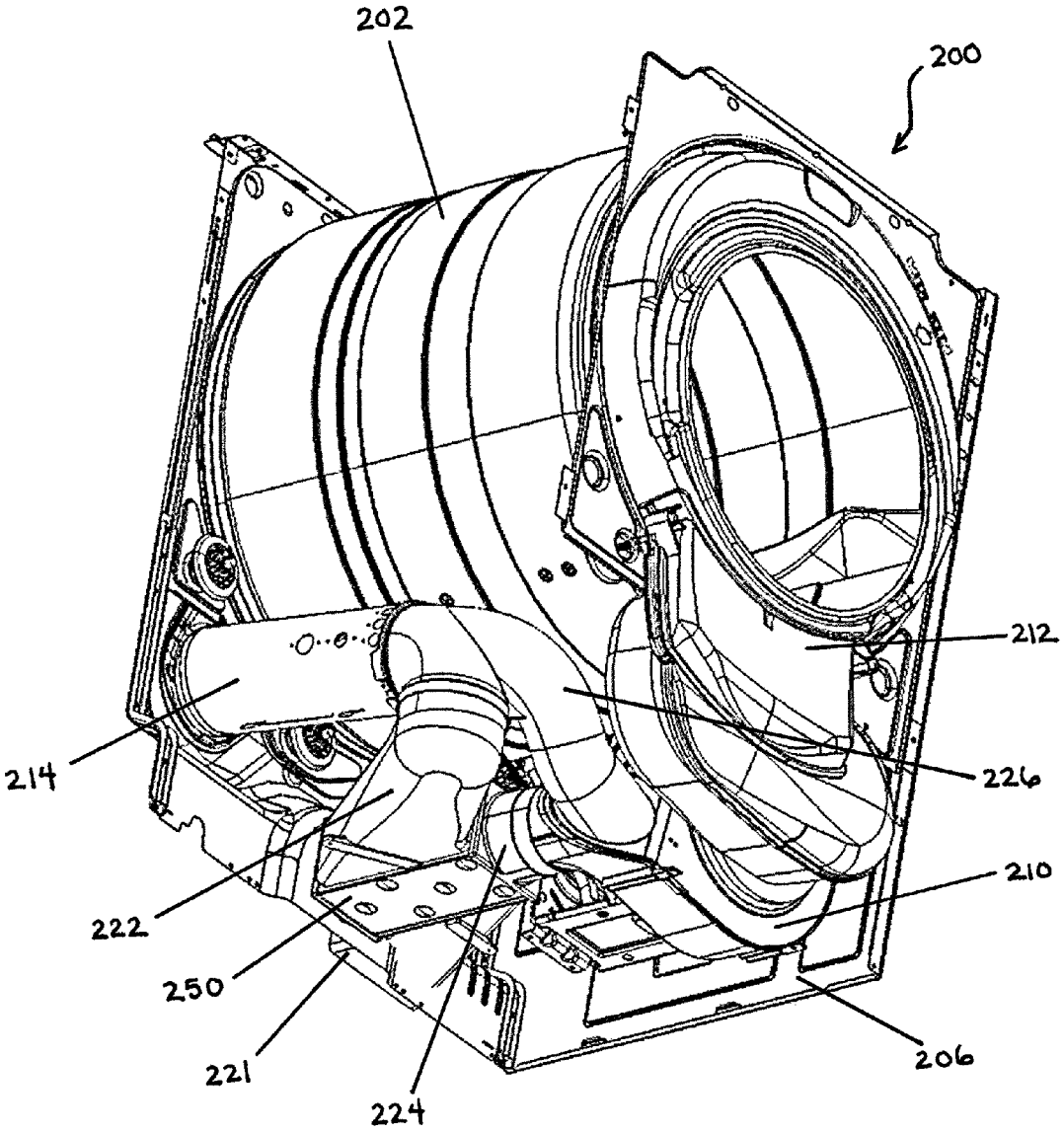
FIG. 21 shows a bottom-front perspective view of a dryer incorporating the basement portion components of FIG. 19, with cabinet panels omitted to reveal internal structure.
Figure 22:
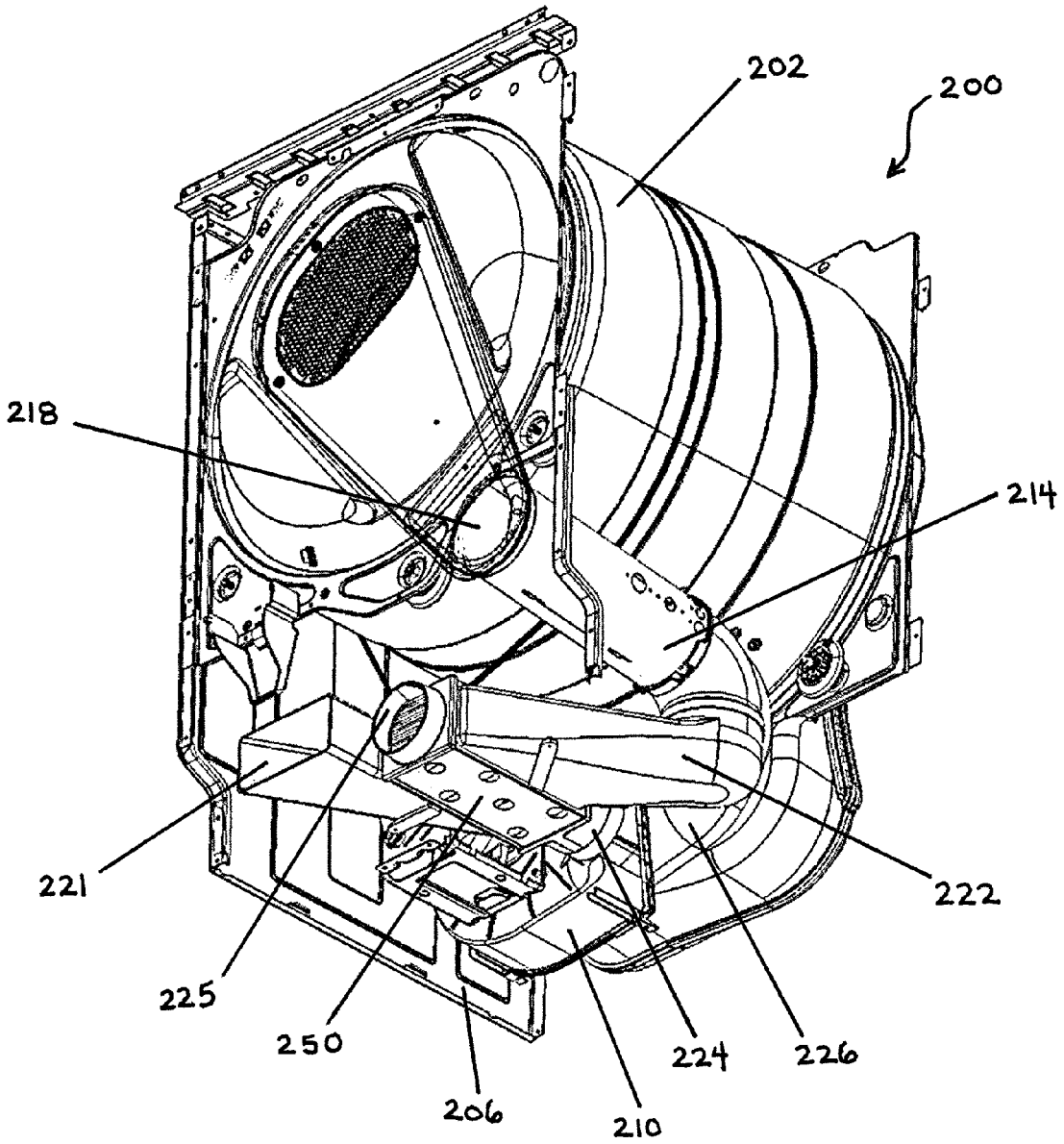
FIG. 22 is a bottom-rear perspective view of the dryer shown in FIG. 21, with portions of the dryer housing removed to reveal internal structure.

FIGS. 19-29 depict a second embodiment, namely a vented tumble dryer 200 provided with a subassembly 220 that provides not only air recirculation as in the first embodiment, but also air-to-air heat exchange. As schematically shown in FIG. 18, in this embodiment, heat exchanger 250 pre-heats the intake air 260 to be admitted into the heater tube 214 and then into the drum 202. In addition, a portion of the exhausted air 264 is directed from the air exhaust passage 224 through a recirculation passage 226 and back to the supply passage 222 downstream of heat exchanger 250. It is to be noted that, as with the first embodiment, due to the placement of the process fan/blower 210 operating in suction mode downstream of the drum 202, the relatively low pressure generated in the drum 202 draws additional air 266 through the non-airtight drum 202 and into the flow, as depicted by arrow 166 in FIG. 18. Thus, the air flow on the high pressure downstream side of fan 210 may be substantially, e.g., 50% to 80%, greater than the flow on the upstream side of drum 202.

An air-to-air heat exchanger 250 provides thermal communication between the air flowing in the air exhaust passages 224/225 downstream of the fan/blower 210, and the air flowing in the air supply passages 221/222 upstream of the heater tube 214. The arrangement recovers heat from exhaust air 264 to pre-heat the ambient intake air 260 prior to that air entering the heater tube 214. In accordance with known principles and constructions, the air-to-air heat exchanger 250 keeps the air flows 260 (intake) and 264 (exhaust) separate from each other, while providing high thermal conductivity between the two.

Additionally, in the second embodiment of FIGS. 18-29, heat energy from the exhaust air 264 is transferred to the supply air 260 through use of recirculated air 262, similar to the first embodiment of FIGS. 4-17. In the illustrated second embodiment including subassembly 220, fresh air enters the air supply intake passage 221 and travels through the heat exchanger 250 prior to passing through an air supply conduit 222 on the opposite side of heat exchanger 250. From there, the air flows into heater tube 214 to be heated by heater 216 therein (which may comprise multiple heating elements). In the illustrated embodiment, the air supply passage 221 is configured and situated to draw in ambient air 260 from outside the dryer cabinet 206. As an alternative, the fresh air 260 could be drawn from inside the dryer cabinet 206, similar to the first embodiment, to thereby achieve additional beneficial heat transfer.

The heated air then enters the manifold 218 (FIG. 22) and continues into the drum 202 to dry a laundry load that may be tumbling therein, similar to the first embodiment. The moisture laden air is then drawn past the conventional lint filter 212 and into the air exhaust passage 224 by a fan/blower 210 located beneath the drum 202, operating in a suction mode. A portion of the moist exhaust air 264 is then diverted into an air recirculation passage 226 arranged between the outlet of fan 210 and the inlet of air exhaust passage 224. This recirculated air 262 travels through the air recirculation passage 226 toward the air intake conduit 222. Upon re-entering the air intake conduit 222, the recirculated air 262 combines with fresh incoming air 260 and flows toward the heater tube 214, etc. The remaining exhaust air 264 that does not enter the recirculation passage 226 continues to flow through exhaust passage 224, and into the heat exchanger 250 where it gives up some heat to the incoming fresh air 260. This exhaust air 264 then exits the heat exchanger 250 into the air exhaust tube 225 provided downstream thereof In an installed orientation, the air recirculation channel 226 extends upwardly from its point of connection to the exhaust channel 224 at the outlet of fan 210 to its point of connection to the inlet channel 222 and/or heater tube 214. The air inlet channel 222 also extends upwardly from its point of connection to the heat exchanger 250 to its point of connection at the heater tube 214. As such, the connecting part of the heater tube 214 may be arranged at a greater height than the tubing/ductwork forming the air supply passages 221 and 222 and the air exhaust passage 224, e.g., with respect to the floor of the dryer 200. Moreover, these components may be wholly contained in the space below the drum, as will be described further.

Figure 23:
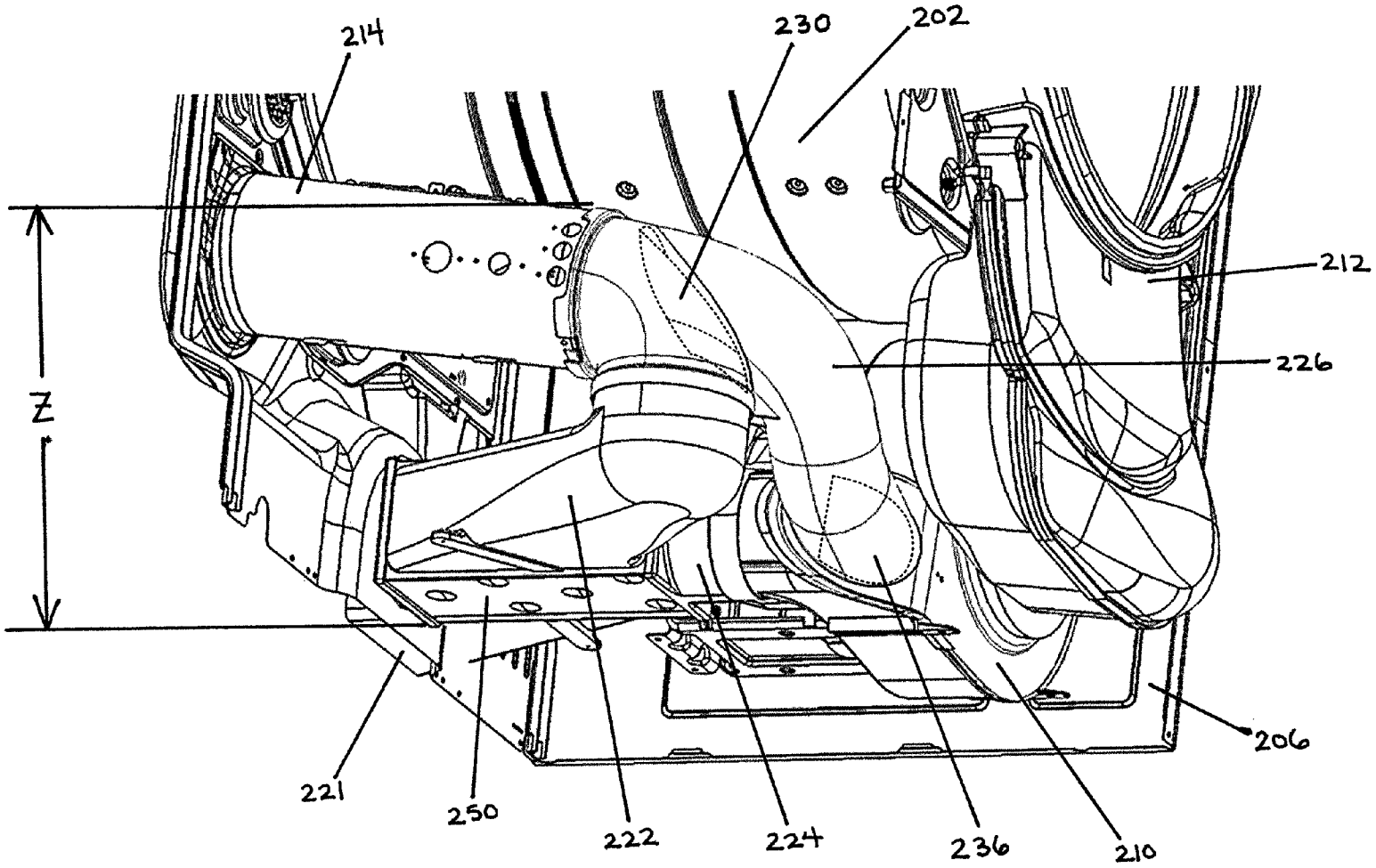
FIG. 23 is a partial bottom-side perspective view of the dryer shown in FIG. 21, with portions of the dryer housing removed to reveal internal structure.
Figure 24:
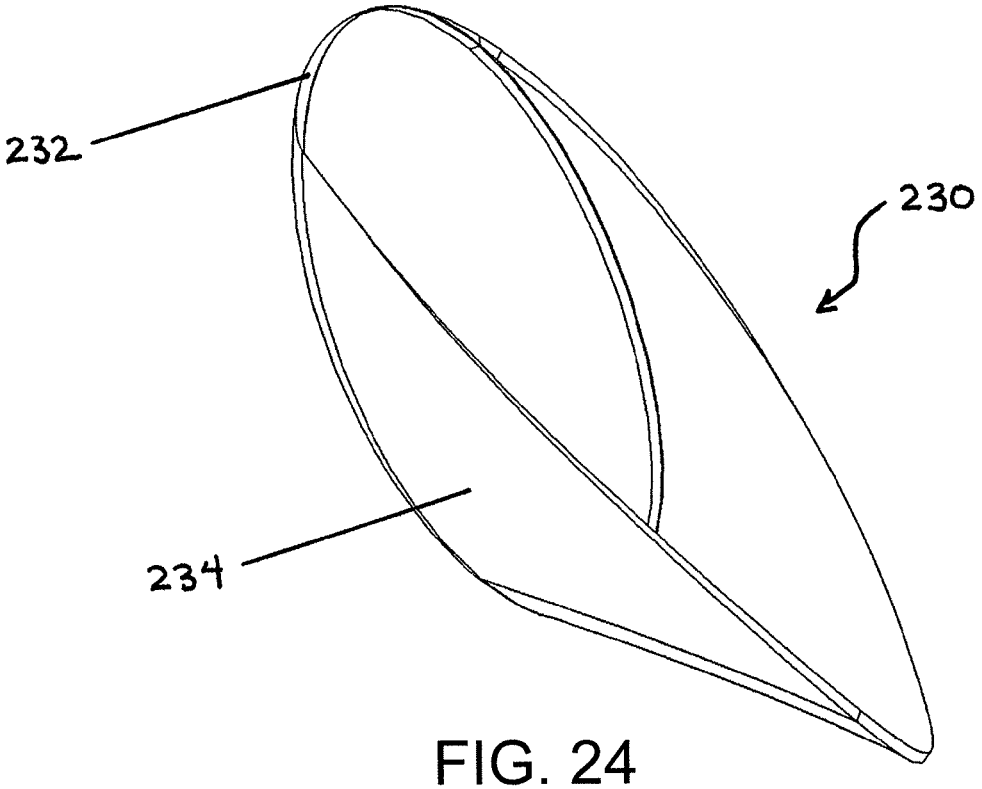
FIG. 24 is a perspective view showing, in isolation, a recirculation air flow directing device implemented in the second embodiment, as also seen in FIG. 23.
Figure 25:
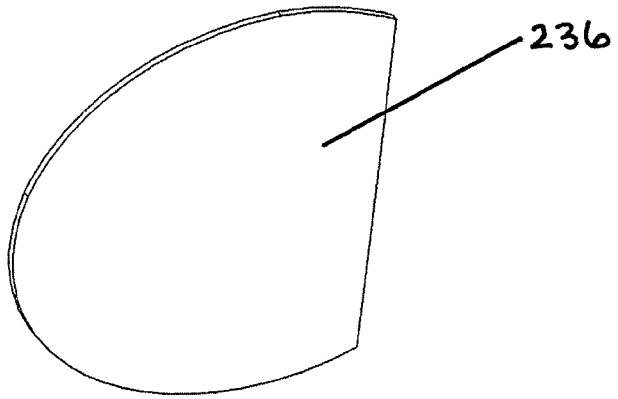
FIG. 25 is a perspective view showing, in isolation, a flow regulating flap implemented in the second embodiment, as also seen in FIG. 23.
Figure 26:
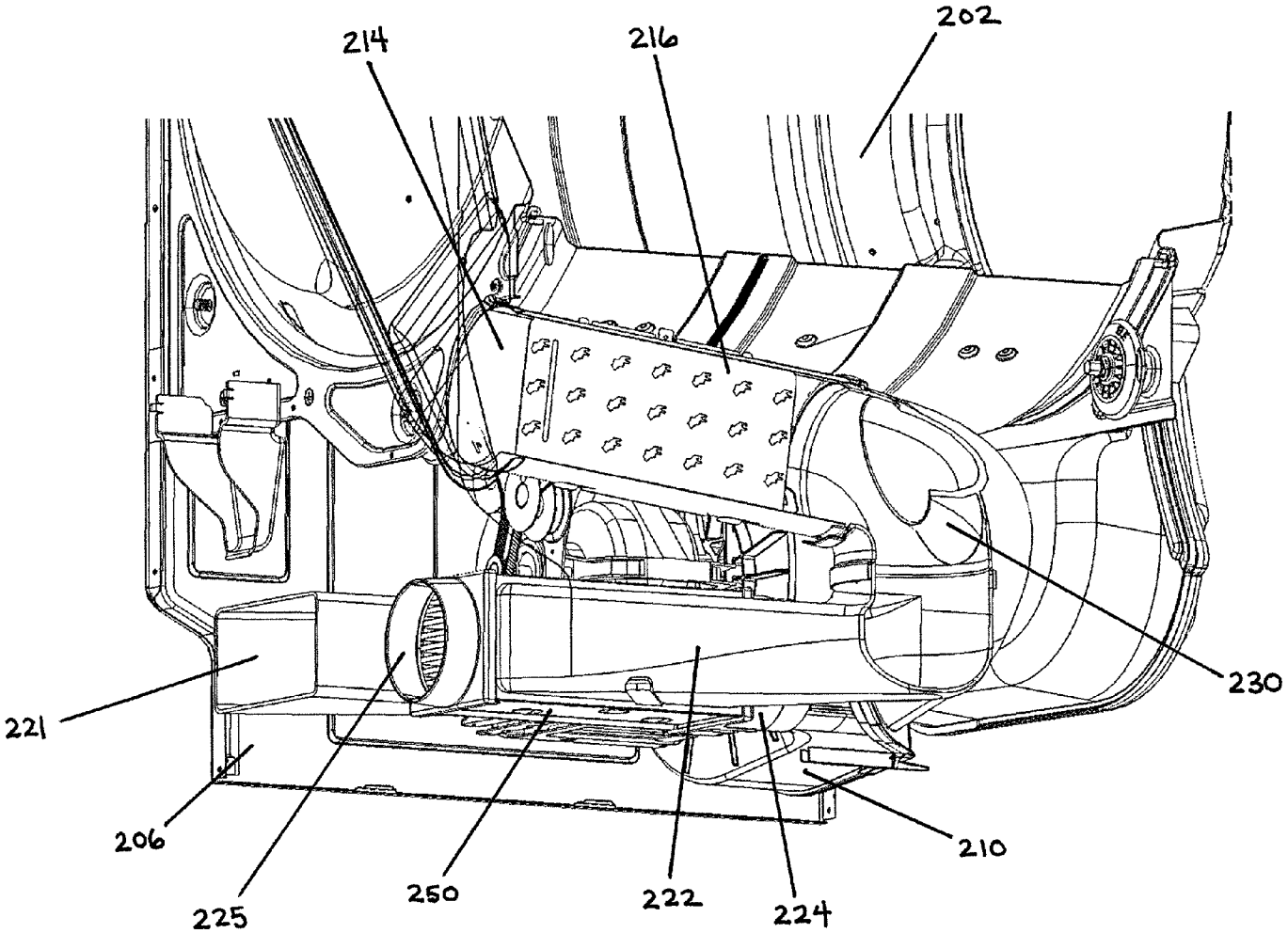
FIG. 26 is a partial perspective view, partially in cross-section, of the dryer of the second embodiment, illustrating aspects of the heat exchanger and recirculation air flow components.

In the illustrated embodiment of the air recirculation and heat exchange subassembly 220, two devices 230 and 236 are used to direct and regulate the recirculation air flow 262. As shown in FIGS. 23-25, a flow directing device 230 is provided at the junction of the recirculation passage 226 and the supply passage 222 to aid in directing the recirculated air 262 exiting the recirculation passage 226 into the air supply passage 222 and toward the heater tube 214, along with the flow of fresh intake air 260. Device 230 thus helps to prevent the backflow of recirculated air 262 out of the fresh air supply passages 221/222, generally similar to flap 130 of the first embodiment. The device 230 is arranged at the connection between the upwardly extending air inlet tube 222 and the upwardly extending recirculation passage 226.

In some embodiments, device 230 may be integrally molded with the tubing/ductwork forming the recirculation passage 226 and/or the inlet air conduit 222. For example, the device 230 and the tubing forming the recirculation passage 226 may be injection molded as a single part. Alternatively, as suggested in FIG. 24, the device 230 may be formed as a separate piece. In this case, it may have a configuration similar to a head visor, with a closed ring band portion 232 through which recirculated air 262 is allowed to flow, and a visor-like flap member 234 appended on a side of the band portion 232. Whether formed integrally or formed separately and attached, flap member 234 provides a convex surface on one side and a concave surface on its opposite side. Device 230 is oriented in the tubing with the visor-like flap portion 234 extending on a lower side thereof, with symmetry about a lowermost central point. The visor portion 234 presents its convex surface on the downward side, and its concave surface on the upward side. If device 230 is formed separately and attached to the tubing (one or both of conduits 222 and 226), the attachment may be by ultrasonic welding, spot welding, or other attachment means as known in the art.

Figure 27:
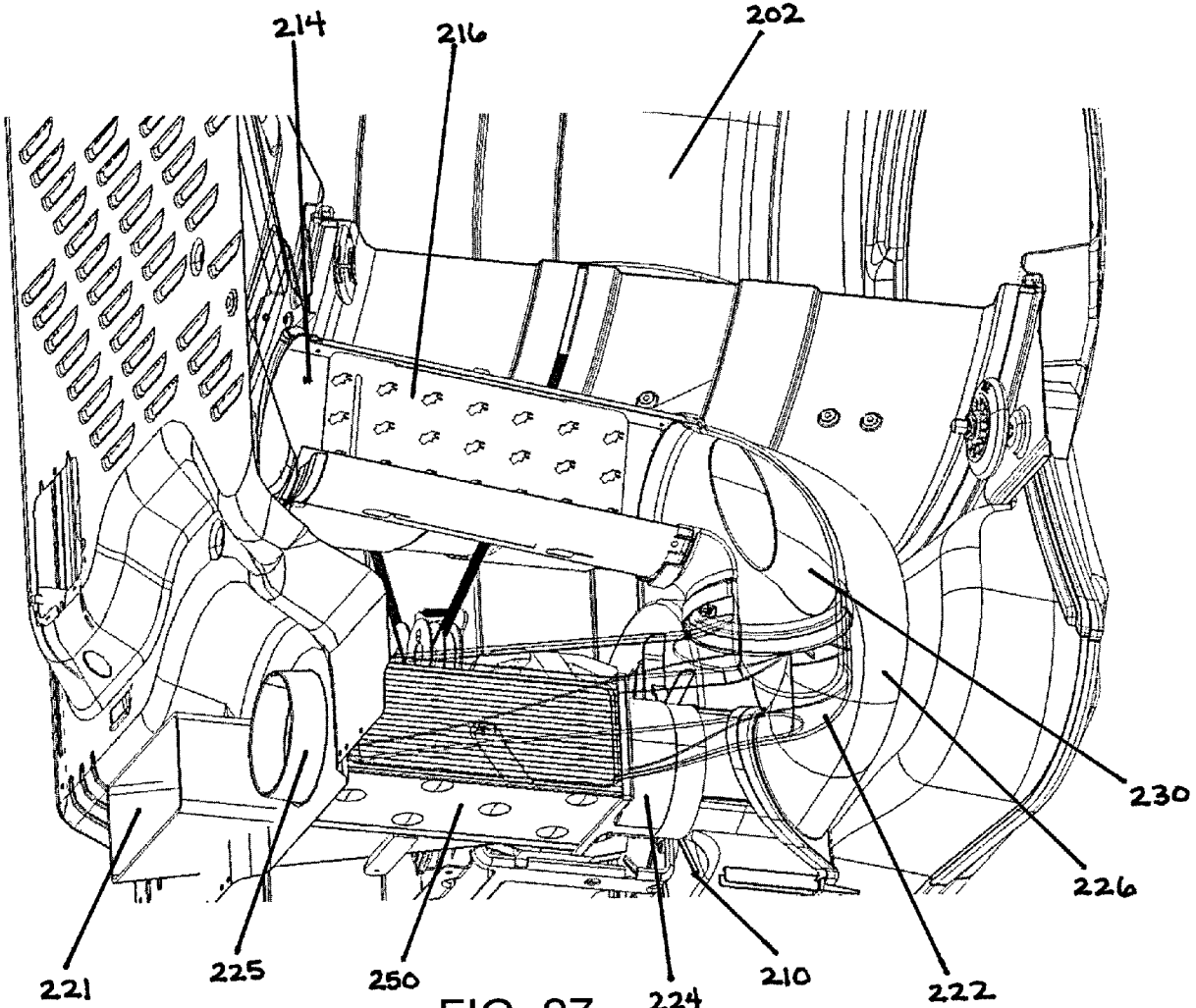
FIG. 27 is a partial bottom-side perspective view, partially in cross-section and partially in wire-frame, of the dryer of the second embodiment, further illustrating aspects of the heat exchanger and recirculation airflow components.

As best seen in FIG. 27, recirculation air flow 262 in recirculation passage 226 is allowed to flow smoothly across the concave upper surface 234 of the visor-like flap 230, toward the heater tube 214 and, in the event the flap 234 is formed as a separate attached component, through circular band 232 that may serve an attachment function. The upward inclination of the visor-like flap 234 directs the recirculation air 262 over and away from the juncture with the inlet air conduit 222, to thereby help avoid backflow into the inlet conduit 222. On the other hand, fresh intake air 260 from conduit 222 is directed by the convex underside 234 of flap 230 to flow smoothly toward heater tube 214 while mixing with the recirculation air flow 262. In this connection, the underside surface 234 of flap 230 helps transition the inlet air flow 260 from a generally vertical flow within the connecting end of intake conduit 222 to the horizontal or slightly upwardly inclined flow direction of the heater tube 214. Other geometries are possible.

Figure 29:
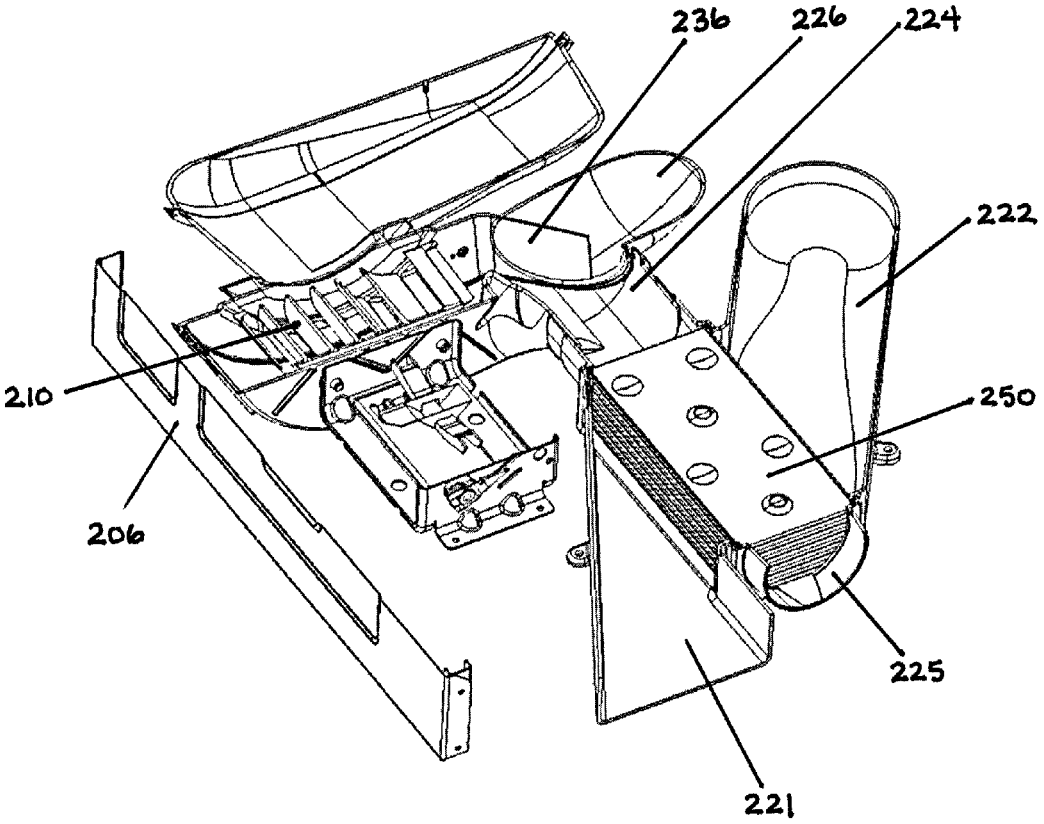
FIG. 29 is a partial perspective cross-sectional view of some of the recirculation and heat exchange components situated in the basement portion of the second embodiment as seen in FIG. 20.

As further illustrated in FIGS. 23, 25, and 29, a flow regulating flap 236 is included in the recirculated air and heat exchange subassembly 220. Unlike the first embodiment with air recirculation subassembly 120, the recirculation passage 226 of the second embodiment is not provided at a large angle relative to the flow direction of the air exiting the fan/blower 210; rather, it is the exhaust passage 224 that is at a significant angle relative to fan 210's outflow direction. Thus, if left by itself, it is likely that an excessive amount of the air leaving the fan 210 would travel into the recirculation passage 226. To address this issue, in the second embodiment, not only is the flow directing device 230 (e.g., FIG. 24) provided, but also a flow amount regulating flap 236 (e.g., FIG. 25) is provided.

As illustrated in FIG. 23, the flow regulating flap 236 is positioned at the junction between the inlet of the air recirculation passage 226 at its point of connection to the fan 210 outlet, and the inlet of the air exhaust passage 224 at its point of connection to the fan 210 outlet. The flap 236 has a semi-circular or arched shape (other geometries are possible) to fit flushly within the recirculation passage 226, across its angled end which joins with a 45 degree angled attachment portion 211 of the fan 210 (e.g., FIG. 28). In this manner, flap 236 serves to substantially restrict the size of the inlet to the recirculation passage 226, e.g., by 50% to 90%, to thereby restrict the flow of air therethrough. In one embodiment, for example, the restriction may be 70%. At the same time, the angled orientation of the flap 236 (e.g., 45 degrees) serves to direct a major portion of the exhaust air 264 exiting the fan 210 to flow down the exhaust passage 224, through heat exchanger 250, and out of the dryer through passage 225. In the illustrated embodiment, flap 236 is connected to recirculation conduit 226, but alternatively may be connected to exhaust conduit 224 or both conduits 224 and 226. Flap 236 may be integrally formed with the conduit 224 or 226 by, for example, injection molding. Alternatively, flap 236 may be a separately formed component secured to conduit(s) 224 and/or 226 by ultrasonic welding, spot welding, or other attachment methods readily known in the art.

As in the first embodiment illustrated in FIGS. 4-17, various aspects of the configuration, arrangement, and sizing of components of the air recirculation and heat exchange subassembly 220 may be used to control the direction and amount of recirculation airflow 262 in accordance with the invention. For example, as in the illustrated second embodiment of FIGS. 18-29, the controlling (i.e., minimum) cross-section of the air recirculation passage 226 may be made smaller than the minimum cross-section of the air exhaust passage 224, to restrict the amount of recirculated air 262 entering the recirculation passage 226. As with the first embodiment, the minimum cross-section of the air recirculation passage 226 may be 20% to 90% smaller than the minimum cross-section of the air exhaust passage 224. Such a restriction of cross-sections could be used in conjunction with, or in lieu of, flow regulating flaps or devices 230 and/or 236. As with the first embodiment, the ratio of recirculated air 262 to fresh air 260 that enters the heater tube 214 may be regulated to be within a range of 0.8:1 to 1.2:1 and most preferably approximately 1:1. Efficiency gains are believed to be obtainable within this range. Although a higher ratio, e.g., above 1.2:1, may result in some condensation internal the cabinet due to air losses or backflow, a higher ratio may improve dryer 200 performance in the case of a small laundry load.

Additionally, the second embodiment featuring the recirculation and heat exchange subassembly 220 may include additional features described in connection with the first embodiment. For example, the recirculation and heat exchange subassembly 220 may feature a cleanable or replaceable recirculation filter similar to filter 140 of the first embodiment. For example, in some embodiments, a filter may be positioned in the exhaust duct upstream of the heat exchanger 250 and overlying the inlet to the recirculation passage in the region of flap 236. The heat exchanger could be made removable through an access in a lower rear cabinet portion, to permit access to and removal of the filter for replacement or cleaning.

As with the first embodiment, the recirculation and heat exchange subassembly 220 may be integrated within a conventional vented tumble dryer with few modifications to the existing structure. This could be done at the time of manufacture or as a modular retrofit to an existing appliance, e.g., a known tumble dryer 10 as shown in FIGS. 1-3. For example, the recirculation and heat exchange subassembly 220, including air intake passage 222, air exhaust passage 224, air recirculation passage 226, flow directing device 230, flow regulating flap 236, and heat exchanger 250, may replace the conventional exhaust tube 18 (FIGS. 1-3), and be fitted onto the heater tube 214 on one end and the outlet of the fan/blower 210 on the other in the space existing below the drum 202 (corresponding to drum 12 of the dryer 10 shown in FIGS. 1-3) without having to move or modify existing components.

Figure 28:
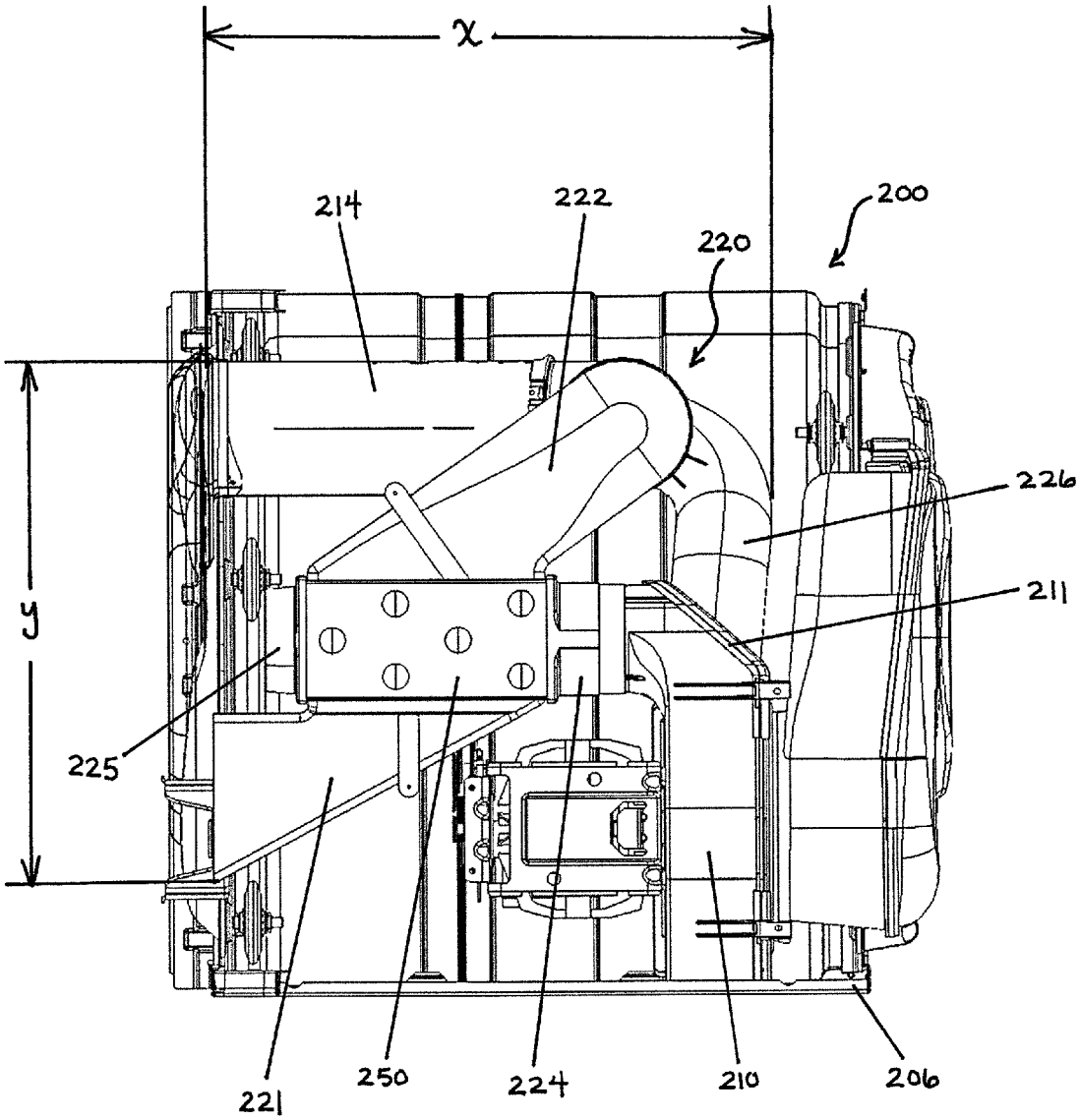
FIG. 28 is a bottom plan view of the dryer of the second embodiment, with the bottom cabinet panel removed to reveal internal components.

For usefulness in fitting within such a space of a range of known dryers, the recirculation subassembly 220 may have a maximum depth dimension X up to approximately 31" (787 mm), a maximum width dimension Y up to approximately 27" (686 mm), and a maximum height dimension Z of up to approximately 20" (508 mm), as shown in FIGS. 23 and 28. More preferably, these dimensions X, Y, and Z would be no greater than approximately 27.5" (700 mm), 24" (600 mm), and 16" (400 mm), respectively. In the exemplary embodiment illustrated in FIGS. 8 and 14, configured to fit within the known dryer of FIGS. 1-3, the dimensions X, Y, and Z are approximately 20" (500 mm), 20" (500 mm), and 14" (350 mm), respectively.

In the illustrated embodiment, other than replacement of the exhaust tube 18, only minor modifications to the known dryer of FIGS. 1-3 may be required, for example, to the housing of the fan 210 where the exhaust passage 224 and recirculation passage 226 branch off (e.g., angled fan attachment portion 211 seen in FIG. 28), and to the dryer cabinet back panel to accommodate intake passage 221. Thus, the recirculation and heat exchange subassembly 220 may be added to, or integrated into, existing dryer designs to improve energy efficiency with little modification to existing parts.

The present invention has been described in terms of preferred and exemplary embodiments thereof. Numerous other embodiments, modifications, and variations within the scope and spirit of the appended claims will occur to persons of ordinary skill in the art from a review of this disclosure.

The invention claimed is:

1. A subassembly for a dryer with a heating tube, a process air fan, and a drum, the subassembly comprising:

an air inlet passage configured to join with an inlet of the heating tube of the dryer;

an air exhaust passage configured to join with an outlet of the process air fan of the dryer;

an air recirculation passage provided between the air inlet passage and the air exhaust passage;

a flow directing flap provided at a junction of the air recirculation passage and the air inlet passage, serving to direct a recirculation air flow toward the heating tube and away from an inlet end of the air inlet passage, wherein the flow directing flap comprises a band portion and a visor-like flap portion connected to said band portion; and a flow regulating flap provided at a junction of the air exhaust passage and the air recirculation passage;

wherein, the subassembly is configured to fit beneath the drum of the dryer in interconnection with the inlet of the heating tube and the outlet of the process air fan.

2. The subassembly of claim 1, further comprising a heat exchanger providing thermal communication between the air inlet passage and the air exhaust passage.

3. The subassembly of claim 1, wherein a minimum cross-section of the air exhaust passage is larger than a minimum cross-section of the air recirculation passage.

4. The subassembly of claim 1, wherein the visor-like flap portion comprises a convex surface on a first side and a concave surface on an opposite side.

5. A laundry dryer comprising:

a drying chamber;

an air inlet passage provided upstream of the drying chamber for supplying air to the drying chamber;

an air exhaust passage provided downstream of the drying chamber for exhausting heated air and water vapor from the drying chamber;

a heater positioned along the air inlet passage for heating air passing through the air inlet passage;

a process air fan downstream of the drying chamber and upstream of the air exhaust passage;

an air recirculation passage fluidly connecting the air exhaust passage and the air inlet passage;

a flow directing flap provided adjacent a junction of the air recirculation passage and the air inlet passage, serving to direct a recirculation air flow toward the heater and away from an inlet end of the air inlet passage, wherein the flow directing flap comprises a band portion and a visor-like flap portion connected to said band portion; and a flow regulating flap provided immediately adjacent a junction of the air exhaust passage and the air recirculation passage, serving to regulate an amount of air flow into the air recirculation passage.

6. The laundry dryer of claim 5, further comprising a heat exchanger providing thermal communication between the air inlet passage and the air exhaust passage.

7. The laundry dryer of claim 5, wherein a minimum cross-section of the air exhaust passage is larger than a minimum cross-section of the air recirculation passage.

8. The laundry dryer of claim 5, wherein the air inlet passage, the air exhaust passage, the air recirculation passage, the flow directing flap, and the flow regulating flap are collectively configured to mix recirculated air with fresh air upstream of the heater in a ratio of recirculated air to fresh air no greater than 1.2:1.

9. The laundry dryer of claim 5, wherein the visor-like flap portion comprises a convex surface on a first side serving to direct inlet air toward said heater, and a concave surface on an opposite side serving to guide recirculation air past said air recirculation passage and toward said heater.

10. A modular recirculation air flow unit for an exhaust-type laundry dryer comprising:

an air inlet duct configured to join with an inlet of a heater of a laundry dryer;

an air exhaust duct configured to join with an outlet of a process air fan of the laundry dryer;

an air recirculation duct provided between the air inlet duct and the air exhaust duct; and a heat exchanger providing thermal communication between the air inlet duct and the air exhaust duct;

wherein, said unit has a maximum depth dimension of no greater than approximately 31" (787 mm), a maximum width dimension of no greater than approximately 27" (686 mm), and a maximum height dimension of no greater than approximately 20" (508 mm);

wherein, in an installation orientation of the unit in the laundry dryer, the air recirculation duct extends upwardly at a non-right angle from its point of connection to the air exhaust duct to its point of connection to the air inlet duct;

wherein, in an installation orientation of the unit in the laundry dryer, the air inlet duct extends upwardly at an angle from its point of connection to the heat exchanger to its point of connection at the heater; and wherein a connecting part of the heater is arranged at a greater height than the air inlet duct and the air exhaust duct with respect to a bottom floor of the laundry dryer.

11. A modular recirculation airflow unit according to claim 10, wherein said maximum depth dimension is no greater than approximately 27.5" (700 mm), the maximum width dimension is no greater than approximately 24" (600 mm), and the maximum height dimension is no greater than approximately 16" (400 mm).

12. A modular recirculation airflow unit according to claim 10, wherein said maximum depth dimension is approximately 20" (500 mm), the maximum width dimension is approximately 20" (500 mm), and the maximum height dimension is approximately 14" (350 mm).

13. An exhaust-type laundry dryer including a rotatable drum and a modular recirculation air flow unit fitted beneath the drum, said air flow unit comprising:

an air inlet duct configured to join with an inlet of a heater of the laundry dryer;

an air exhaust duct configured to join with an outlet of a process air fan of the laundry dryer;

an air recirculation duct provided between the air inlet duct and the air exhaust duct; and a heat exchanger providing thermal communication between the air inlet duct and the air exhaust duct;

wherein, in an installation orientation of the unit, the air recirculation duct extends upwardly from its point of connection to the exhaust duct to its point of connection to the air inlet duct;

wherein, in an installation orientation of the modular unit, the air inlet duct extends upwardly at a non-right angle from its point of connection to the heat exchanger to its point of connection at the heater; and wherein a connecting part of the heater is arranged at a greater height than the air inlet duct and the air exhaust duct with respect to a bottom floor of the dryer.

14. A laundry dryer according to claim 13, wherein a flow regulating flap is situated at the point of connection of the air recirculation duct to the air inlet duct.

15. A laundry dryer according to claim 14, wherein a flow regulating flap is situated at the point of connection of the air recirculation duct to the air exhaust duct.

16. A laundry dryer according to claim 13, wherein a flow regulating flap is situated at the point of connection of the air recirculation duct to the air exhaust duct.

17. A laundry dryer according to claim 13, wherein, in said installation orientation of the unit, the air inlet duct extends upwardly from its point of connection with said heat exchanger to its point of connection with said air recirculation duct.

* * * * *